US010285527B2

(12) United States Patent
Mullet et al.

(10) Patent No.: US 10,285,527 B2
(45) Date of Patent: May 14, 2019

(54) MOTORIZED DRAPERY APPARATUS WITH BATTERIES POSITIONED IN THE BRACKETS

(71) Applicant: QMotion Incorporated, Pensacola, FL (US)

(72) Inventors: Willis Jay Mullet, Gulf Breeze, FL (US); Darrin W. Brunk, Pensacola, FL (US); Derek Scott Paquette, Daphne, AL (US)

(73) Assignee: CURRENT PRODUCTS CORP., Pensacola, FL (US)

( * ) Notice: Subject to any disclaimer, the term of this patent is extended or adjusted under 35 U.S.C. 154(b) by 619 days.

(21) Appl. No.: 14/902,982

(22) PCT Filed: Jul. 11, 2014

(86) PCT No.: PCT/US2014/046336

§ 371 (c)(1),
(2) Date: Jan. 5, 2016

(87) PCT Pub. No.: WO2015/009565

PCT Pub. Date: Jan. 22, 2015

(65) Prior Publication Data

US 2017/0000280 A1 Jan. 5, 2017

Related U.S. Application Data

(60) Provisional application No. 61/856,143, filed on Jul. 19, 2013.

(51) Int. Cl.
*A47H 5/02* (2006.01)
*A47H 5/06* (2006.01)
(Continued)

(52) U.S. Cl.
CPC ..... *A47H 5/06* (2013.01); *A47H 1/02* (2013.01); *A47H 1/142* (2013.01); *A47H 5/02* (2013.01);
(Continued)

(58) Field of Classification Search
CPC ... A47H 5/06; A47H 5/02; A47H 5/00; A47H 2005/025; A47H 2001/0215;
(Continued)

(56) References Cited

U.S. PATENT DOCUMENTS 1,339,353 A * 5/1920 Kimber ..... A47H 5/06 160/343
1,509,620 A * 9/1924 Taylor ..... B60S 1/18 15/250.26
(Continued)

FOREIGN PATENT DOCUMENTS

GB 2382764 A * 6/2003 ..... A47H 5/00
KR 20100006476 A * 1/2010
(Continued)

OTHER PUBLICATIONS

Chung, English Translation of "KR 20100006476", Obtained from <https://worldwide.espacenet.com> (Year: 2010).*

*Primary Examiner* — Katherine W Mitchell
*Assistant Examiner* — Johnnie A. Shablack
(74) *Attorney, Agent, or Firm* — Christopher A. Proskey; BrownWinick Law Firm

(57) ABSTRACT

A wirelessly controllable, motorized and battery powered drapery apparatus is presented having a rotatable drive element having a guide structure in its surface. The drapery apparatus includes brackets that house conventional batteries which power the apparatus. The brackets connect to a motor assembly which houses a motor and a motor controller. The rotatable drive element includes at least one key
(Continued)

feature in its hollow interior. The guide structure is indexed to the key feature such that two rotatable drive elements can be connected together in such a manner that the guide structure is aligned on the two rotatable drive elements ensuring that the shade material opens and closes evenly.

23 Claims, 36 Drawing Sheets

(51) Int. Cl.
*A47H 1/02* (2006.01)
*A47H 13/02* (2006.01)
*A47H 1/142* (2006.01)
*E06B 9/68* (2006.01)

(52) U.S. Cl.
CPC ..... *A47H 13/02* (2013.01); *E06B 9/68* (2013.01); *A47H 2001/0215* (2013.01)

(58) Field of Classification Search
CPC ..... E06B 2009/6818; E06B 9/68; E06B 9/70; E06B 9/72
See application file for complete search history.

(56) References Cited

U.S. PATENT DOCUMENTS 1,823,909 A * 9/1931 Meier ..... A47H 5/06 160/343
1,954,941 A * 4/1934 Monnier ..... A47H 5/06 160/343
2,256,008 A * 9/1941 Armstrong ..... A47H 5/06 160/331
2,616,499 A * 11/1952 Eckles ..... A47G 5/04 126/551
2,674,307 A * 4/1954 Calmy ..... A47H 5/0325 160/126
2,801,690 A * 8/1957 Bennett ..... A47H 5/06 160/343
2,846,079 A * 8/1958 Leeper ..... B60P 3/05 211/1.57
3,003,552 A * 10/1961 Eilenberger ..... A47H 5/06 160/331
3,045,747 A * 7/1962 Hill ..... A47H 5/04 160/331
3,095,033 A * 6/1963 Polkosnik ..... A47H 1/122 160/126
3,208,507 A * 9/1965 Breen ..... E06B 9/364 160/168.1 V
4,023,609 A * 5/1977 Rosenquist ..... A47H 5/06 160/343
4,171,845 A * 10/1979 Hirsch ..... B60J 1/2019 135/910
4,305,448 A * 12/1981 Stoll ..... A47H 5/02 160/331
4,657,059 A * 4/1987 Clauss ..... E04F 10/0662 160/120
4,832,104 A * 5/1989 De Labarthe ..... E04B 7/166 160/343
4,926,922 A * 5/1990 Shimazaki ..... A47H 5/06 160/331
5,398,900 A * 3/1995 Schober ..... A47H 1/142 248/206.5
5,413,161 A * 5/1995 Corazzini ..... E06B 9/32 160/168.1 P
5,517,094 A * 5/1996 Domel ..... E06B 9/307 160/168.1 P
5,540,269 A * 7/1996 Plumer ..... E06B 9/84 160/133
5,676,189 A * 10/1997 Zeeb ..... B60J 1/2011 104/295
5,760,558 A * 6/1998 Popat ..... E06B 9/32 160/168.1 R
5,793,174 A * 8/1998 Kovach ..... E06B 9/262 318/16
5,990,646 A * 11/1999 Kovach ..... E06B 9/262 318/16
6,024,156 A * 2/2000 Chu ..... A47H 5/0325 160/331
6,060,852 A * 5/2000 Domel ..... E06B 9/307 318/480
6,062,290 A * 5/2000 Domel ..... E06B 9/36 160/176.1 V
6,116,320 A * 9/2000 Peterson ..... E06B 9/32 160/84.02
6,371,192 B1 * 4/2002 Anderson ..... E06B 9/323 160/168.1 P
6,405,782 B1 * 6/2002 Cheng ..... E06B 9/368 160/168.1 P
6,433,498 B1 * 8/2002 Domel ..... E06B 9/307 318/280
6,441,575 B1 * 8/2002 Peterson ..... E06B 9/32 318/433
6,446,693 B1 * 9/2002 Anderson ..... E06B 9/32 160/168.1 P
6,497,267 B1 * 12/2002 Azar ..... E06B 9/42 160/188
6,688,368 B2 * 2/2004 Kovach ..... E06B 9/32 160/168.1 P
6,736,186 B2 * 5/2004 Anderson ..... E06B 9/32 160/168.1 P
6,850,017 B1 * 2/2005 Domel ..... E06B 9/307 318/400.29
6,983,783 B2 * 1/2006 Carmen, Jr. ..... E06B 9/68 160/120
7,051,782 B2 * 5/2006 Nichols, Jr. ..... E06B 9/174 160/120
7,089,991 B2 * 8/2006 Jorgensen ..... E06B 9/40 160/310
7,178,291 B2 * 2/2007 Vasquez ..... E06B 7/096 49/74.1
7,240,716 B2 * 7/2007 Nichols, Jr. ..... E06B 9/174 160/120
7,635,018 B2 * 12/2009 Carmen, Jr. ..... E06B 9/68 160/188
7,673,667 B2 * 3/2010 Domel ..... E06B 9/68 160/168.1 P
7,832,052 B2 * 11/2010 Vrielink ..... A47H 5/0325 16/87.4 R
7,891,399 B2 * 2/2011 Rasmussen ..... E06B 9/42 160/120
8,122,932 B2 * 2/2012 Cannaverde ..... E06B 9/174 160/120
8,267,234 B2 * 9/2012 Koop ..... F16D 7/044 192/55.2
8,342,225 B2 * 1/2013 Fortunato ..... E06B 9/42 160/120
8,368,328 B2 * 2/2013 Mullet ..... E06B 9/42 318/255
8,579,004 B2 * 11/2013 Cannaverde ..... E06B 9/174 160/120
9,095,907 B2 * 8/2015 Mullet ..... E06B 9/72
9,095,908 B2 * 8/2015 Mullet ..... E06B 9/72
9,279,286 B2 * 3/2016 Higgins ..... E06B 9/174
9,394,743 B2 * 7/2016 Mullet ..... E06B 9/40
9,410,371 B2 * 8/2016 Faller ..... E06B 9/322
9,488,000 B2 * 11/2016 Kirby ..... E06B 9/42
9,540,873 B1 * 1/2017 Townsley ..... B60J 1/205
9,615,687 B2 * 4/2017 Mullet ..... E06B 9/72
9,644,424 B2 * 5/2017 Slivka ..... E06B 9/42
9,725,949 B2 * 8/2017 Townsley ..... B60J 1/205
9,725,952 B2 * 8/2017 Mullet ..... E06B 9/40
9,801,486 B2 * 10/2017 Mullet ..... A47H 23/01
9,890,585 B2 * 2/2018 Mullet ..... E06B 9/42
9,926,741 B2 * 3/2018 Faller ..... E06B 9/322
9,999,313 B2 * 6/2018 Mullet ..... A47H 1/102
2004/0129849 A1 * 7/2004 Walker ..... E06B 9/174 248/266

(56) References Cited

U.S. PATENT DOCUMENTS

2005/0119057 A1* 6/2005 Rom ..... F16D 3/18 464/158
2005/0172563 A1* 8/2005 Komoda ..... A47H 5/0325 49/358
2006/0000565 A1* 1/2006 Billebault ..... E06B 9/36 160/343
2006/0086874 A1* 4/2006 Habel ..... E06B 9/174 248/268
2006/0272782 A1* 12/2006 Nichols, Jr. ..... A47H 5/0325 160/120
2007/0253768 A1* 11/2007 Li ..... E06B 9/174 403/305
2008/0067278 A1* 3/2008 Fortunato ..... E06B 9/42 242/407
2008/0135191 A1* 6/2008 Zakowski ..... E06B 9/50 160/181
2008/0244999 A1* 10/2008 Westermann ..... E06B 1/28 52/204.1
2009/0283225 A1* 11/2009 Luger ..... A47H 5/0325 160/310
2010/0122781 A1* 5/2010 Charleux ..... A47H 5/0325 160/331
2010/0181031 A1* 7/2010 Cannaverde ..... E06B 9/174 160/314
2010/0294440 A1* 11/2010 Li ..... E06B 9/42 160/310
2011/0048655 A1* 3/2011 Andreasen ..... E06B 9/72 160/310
2011/0241555 A1* 10/2011 Lin ..... A47H 1/022 315/159
2011/0247174 A1* 10/2011 Keishold ..... A47H 1/02 16/87.4 R
2012/0132376 A1* 5/2012 Cannaverde ..... E06B 9/174 160/133
2014/0076115 A1* 3/2014 Lee ..... E06B 9/72 82/1.11
2014/0076505 A1* 3/2014 Mullet ..... E06B 9/72 160/108
2014/0262077 A1* 9/2014 Watkins ..... E06B 9/68 160/310
2015/0107788 A1* 4/2015 Mullet ..... A47H 1/02 160/405
2015/0159430 A1* 6/2015 Huang ..... A47H 1/04 160/168.1 P
2015/0272370 A1* 10/2015 Mullet ..... E06B 9/72 29/428
2015/0327705 A1* 11/2015 Mullet ..... A47H 23/01 160/331
2016/0053537 A1* 2/2016 Dybdahl ..... E06B 9/68 160/310
2016/0130865 A1* 5/2016 De Muelenaere ..... E04F 10/10 160/113
2016/0143470 A1* 5/2016 Mullet ..... A47H 1/102 160/331
2016/0374497 A1* 12/2016 McCarthy ..... A47H 5/06 160/310
2017/0000280 A1* 1/2017 Mullet ..... A47H 1/02
2017/0172333 A1* 6/2017 Mullet ..... A47H 5/06
2017/0181562 A1* 6/2017 Mullet ..... A47H 1/02
2017/0238747 A1* 8/2017 Mullet ..... A47H 5/06
2018/0112463 A1* 4/2018 Derk, Jr. ..... E06B 9/72
2018/0163465 A1* 6/2018 Biedermann ..... E06B 9/42
2018/0255953 A1* 9/2018 Mullet ..... A47H 1/102
2018/0325327 A1* 11/2018 Foreman ..... A47K 3/362

FOREIGN PATENT DOCUMENTS

SE 1200240 A1 * 10/2012
WO WO-8602970 A1 * 5/1986 ..... E06B 9/72
WO WO-2014043711 A1 * 3/2014 ..... A47H 1/02
WO WO-2014043713 A1 * 3/2014 ..... A47H 1/02
WO WO-2014169093 A1 * 10/2014 ..... A47H 1/102
WO WO-2015009565 A3 * 11/2015 ..... A47H 1/02

* cited by examiner

MOTORIZED DRAPERY APPARATUS WITH BATTERIES POSITIONED IN THE BRACKETS

FIELD OF THE INVENTION

This invention relates to a drapery. More specifically, and without limitation, this invention relates to a drapery apparatus which includes batteries in the brackets among other features.

BACKGROUND OF INVENTION

Architectural coverings, such as curtains, shades, draperies and the like are old and well known in the art and are frequently used to provide privacy and to limit the amount of light that is permitted to pass through a window and into a room or building. These devices are also used to decorate rooms and provide pleasing and aesthetic appearances. There are countless types, forms and designs of architectural coverings known in the art. The term architectural covering is used to describe any and all of these types, forms and designs including blinds, shades, draperies, and the like.

One form of architectural covering of particular interest in this application is commonly referred to as a drapery or draperies. Common components of draperies include a support rod connected to brackets positioned above or adjacent to a window or door. In one arrangement of a drapery, the support rod rotates and drives the shade material across the length of the support rod. This arrangement is more fully described in Applicant's related patent Application Ser. No. 61/702,093 filed on Sep. 17, 2012 entitled Rotatable Drive Element For Moving A Window Covering, which is fully incorporated by reference herein, including any related applications; Applicant's related patent Application Ser. No. 61/810,949 filed on Apr. 11, 2013 entitled Rotatable Drive Element For Moving A Window Covering Including A Flexible Guide Arm And A Pointed Tooth Arrangement which is also fully incorporated by reference herein, including any related applications; and Applicant's related patent Application Ser. No. 61/817,954 filed on May 1, 2013 entitled Motorized Drapery Apparatus, System And Method Of Use which is also fully incorporated by reference herein, including any related applications.

In at least some of the arrangements presented in these related patent applications, the batteries are either positioned within the rotatable drive element itself or in a separate battery tube which is positioned exterior to the rotatable drive element or the brackets. Each of these arrangements has their own advantages and disadvantages that make each of these arrangements particularly well suited for various applications.

In the arrangement wherein the batteries are positioned within the rotatable drive element, this causes the rotatable drive element to have a substantially thick diameter. By increasing the diameter of the rotatable drive element this increases the cost of the apparatus as additional material is needed to form the rotatable drive element. In addition, by increasing the diameter of the rotatable drive element this increases the mass of the rotatable drive element which requires additional energy to rotate the rotatable drive element. Another side-effect of increasing the size of the rotatable drive element is that this causes the drapery rod to have a substantial appearance that may be undesirable in some applications. Also, by increasing the diameter of the rotatable drive element this prevents the use of many conventional shade materials available on the market, especially the use of what are known as "grommet draperies". In addition, by placing the batteries within the rotatable drive element this increases the weight of the rotatable drive element which requires substantial structural support to prevent bending or bowing of the rotatable drive element. Therefore, substantial deficiencies are caused by positioning the batteries within the rotatable drive element.

In the arrangement wherein the batteries are positioned exterior to the rotatable drive element, while this eliminates some of the problems causes by positioning the batteries in the rotatable drive element, this causes other substantial problems. By positioning the batteries in a separate battery tube assembly, this increases the cost of the architectural covering by requiring additional pieces of the assembly. In addition, by positioning the batteries in a separate battery tube assembly, this complicates and prolongs the installation process as it requires the installation of the battery tube assembly on a wall, ceiling or other structure near the architectural covering which requires additional holes in wall, ceiling or structure. In addition, by positioning a separate battery tube assembly exterior to the apparatus the battery tube assembly is unsightly and detracts from the aesthetic appearance of the apparatus.

Therefore there is a need in the art for a motorized drapery apparatus with batteries positioned in the brackets that functions well and is aesthetically pleasing.

Thus it is a primary object of the invention to provide a motorized drapery apparatus that improves upon the state of the art.

Another object of the invention is to provide a motorized drapery apparatus that is easy to use.

Yet another object of the invention is to provide a motorized drapery apparatus that is efficient.

Another object of the invention is to provide a motorized drapery apparatus that is simple in design.

Yet another object of the invention is to provide a motorized drapery apparatus that is inexpensive.

Another object of the invention is to provide a motorized drapery apparatus that has a minimum number of parts.

Yet another object of the invention is to provide a motorized drapery apparatus that has an intuitive design.

Another object of the invention is to provide a motorized drapery apparatus that is easy to install.

Yet another object of the invention is to provide a motorized drapery apparatus wherein that eliminates the need to position the batteries in the rotatable drive element.

Another object of the invention is to provide a motorized drapery apparatus that eliminates the need for an external battery tube assembly.

Yet another object of the invention is to provide a motorized drapery apparatus that eliminates the need to position the batteries in a finial or a rotatable drive element extension.

Another object of the invention is to provide a motorized drapery apparatus that is wirelessly controllable.

Yet another object of the invention is to provide a motorized drapery apparatus wherein that provides a secure and novel manner and method of connecting the battery tube assembly to the brackets.

Another object of the invention is to provide a motorized drapery apparatus that indexes the guide structure on the rotatable drive element such that two rotatable drive elements can be connected together with the guide structures aligning with one another.

Yet another object of the invention is to provide a motorized drapery apparatus wherein the brackets electrically connect to the other components of the assembly.

Another object of the invention is to provide a motorized drapery apparatus that improves the ease of replacing batteries.

Yet another object of the invention is to provide a motorized drapery apparatus that provides improved wireless range.

These and other objects, features, or advantages of the present invention will become apparent from the specification and claims.

SUMMARY OF THE INVENTION

A wirelessly controllable, motorized and battery powered drapery apparatus is presented having a rotatable drive element having a guide structure in its surface. The drapery apparatus includes brackets that house conventional batteries which power the apparatus. The brackets connect to a motor assembly which houses a motor and a motor controller. The brackets connect to and are held by a bracket coupler. The brackets also include electrical contacts which transmit power to the apparatus when installed on the assembly. The rotatable drive element includes at least one guide structure in its surface and at least one key feature in its hollow interior. The guide structure is indexed to the key feature such that two rotatable drive elements can be connected together in such a manner that the guide structure is aligned on the two rotatable drive elements ensuring that the shade material opens and closes evenly. Two brackets are presented, a short bracket and a long bracket, the use of these varying length brackets enables the installation of two rotatable drive elements, each dedicated to a single shade material, which is often an inner sheer shade and a blackout exterior shade. When energized, the motor rotates the rotatable drive element which drives the shade material across the length of the rotatable drive element thereby moving the shade material between an open position and a closed position.

DETAILED DESCRIPTION OF THE INVENTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the invention(s). The following detailed description is, therefore, not to be taken in a limiting sense, and the scope of the invention is defined only by the appended claims, along with the full scope of equivalents to which such claims are entitled.

As used herein, the terminology such as vertical, horizontal, top, bottom, front, back, end and sides are referenced according to the views presented. It should be understood, however, that the terms are used only for purposes of description, and are not intended to be used as limitations. Accordingly, orientation of an object or a combination of objects may change without departing from the scope of the invention.

As used herein, the invention is shown and described as being used in association with an architectural covering, however, the invention is not so limiting. Instead, one of ordinary skill in the art will appreciate that the system and method presented herein can be applied to any mechanical device, without limitation. The system and method is merely shown and described as being used in association with an architectural covering for ease of description and as one of countless examples.

As used herein, the term architectural covering refers to any covering such as a blind, drapery, roller shade, venetian blind, drapery or the like, especially used in association with windows. This term is in no way meant to be limiting. Instead, one of ordinary skill in the art will appreciate that the system and method presented herein can be applied to any architectural covering, without limitation.

Figure 1:
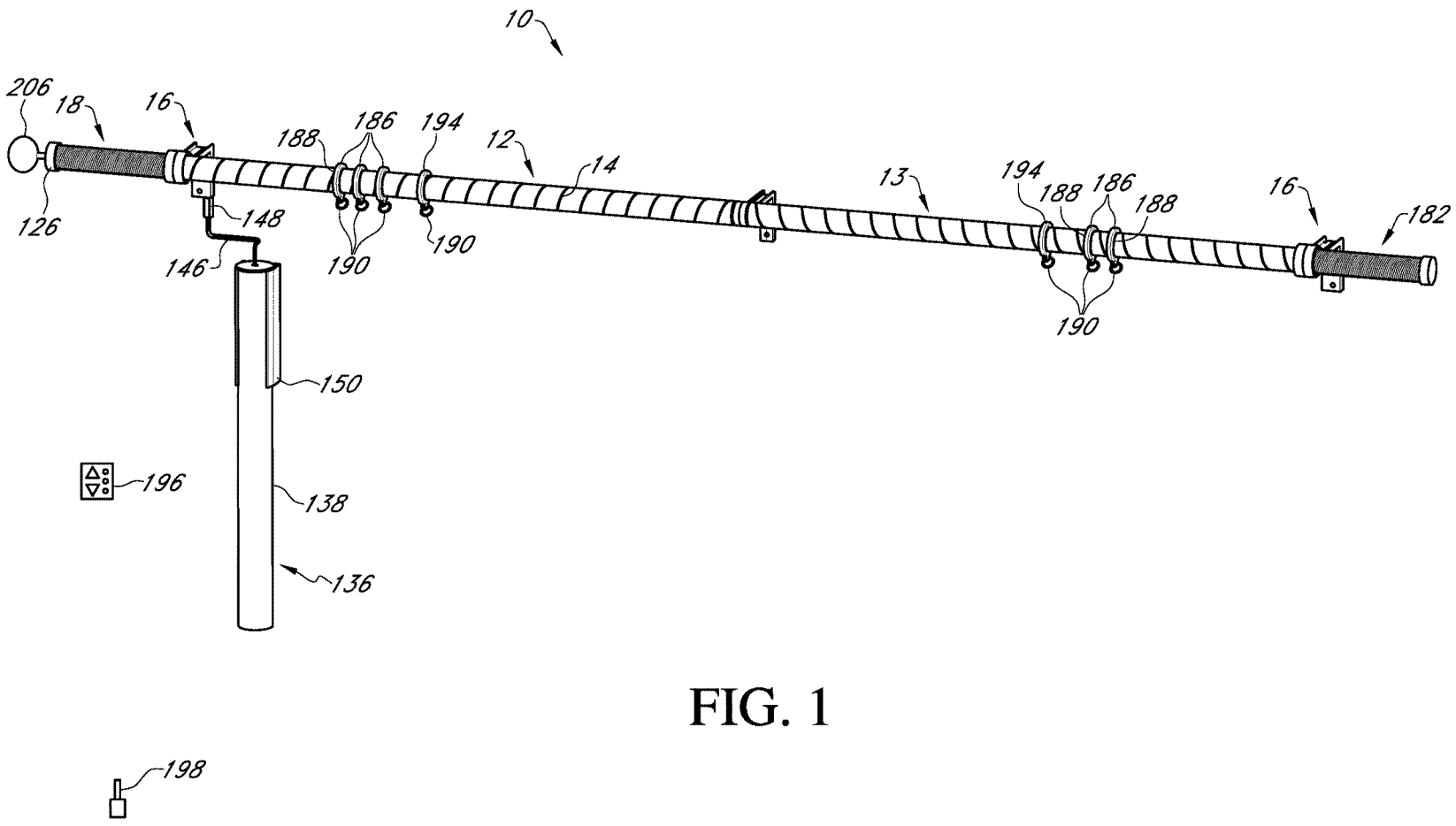
FIG. 1 is a perspective view of an architectural covering having two rotatable drive elements having a helical guide structure therein; the rotatable drive elements are connected at their inward ends by a center coupler; the rotatable drive elements are connected to a bracket at their outward ends; a motor housing with a finial is connected to one end of the rotatable drive element with a battery assembly electrically connected to the bracket adjacent the motor housing which supplies power to the motor housing; a dummy rotatable drive element extension is connected to the bracket on the opposite; and driver attachment elements for driving shade material open and closed are shown on the rotatable drive element.

With reference to FIG. 1, an architectural covering 10 is presented. Architectural covering 10 is formed of any size, shape and design. As one example, as is shown, architectural covering 10 includes a first rotatable drive element 12 connected to a second rotatable drive element 13.

Rotatable Drive Elements:

The first and second rotatable drive elements 12, 13 are any form of a rotating member such as a rod, tube, threaded bar, or the like. In one arrangement, rotatable drive elements 12 and 13 are practically identical if not identical and therefore for simplicity reference to one shall be reference to the other, unless specified otherwise. In one arrangement, rotatable drive element 12 is an elongated hollow tube, having a helical guide structure 14 positioned in its surface, as is described as is described in further detail in Applicant's related Application Ser. No. 61/702,093 filed on Sep. 17, 2012 entitled Rotatable Drive Element For Moving A Window Covering, which is fully incorporated by reference herein, including any related applications; and Applicant's related patent Application Ser. No. 61/810,949 filed on Apr. 11, 2013 entitled Rotatable Drive Element For Moving A Window Covering Including A Flexible Guide Arm And A Pointed Tooth Arrangement which is also fully incorporated by reference herein, including any related applications. The helical guide structure 14 can be a left-hand guide structure, a right-hand guide structure, or both, or a plurality or combination of left-hand guide structures and/or right-hand guide structures. Guide structure 14 can either be grooves, indentations, protrusions, threads or any other feature or the like, as is described herein. Guide structure 14 can either ground or machined into the surface or rotatable drive element 12, knurled into the surface of rotatable drive element 12 (as is described further herein), cast or formed into the surface of rotatable drive element 12, or created by any other means or methods known in the art. In one arrangement, as is shown, the guide structure 14 is a pair of left-hand guide structures positioned opposite one another on rotatable drive element 12 and a pair of right-hand guide structures positioned opposite one another on rotatable drive element 12, wherein the right-hand guide structures and left-hand guide structures.

Wall Brackets: Wall brackets 16 support rotatable drive element 12. Wall brackets 16 are take on any form of a connecting device which supports and connects rotatable drive element 12 to any structural element such as a wall adjacent a window, a ceiling, a frame or the like. As one example, in the arrangement shown, rotatable drive element 12 connects on one side to wall bracket 16 and a motor housing 18 connects on the opposite side.

In the arrangement shown, wall brackets 16 include a mounting plate 20 which connects to the wall, an extension arm 22, which extends between mounting plate 20 and a mounting member 24. Mounting member 24 is formed of any suitable size and shape and serves to connect to rotatable drive element 12 while allowing for functional movement, such as rotation, of the necessary parts. In one arrangement, as is shown, mounting member 24 is a general circular collar which is sized and shaped to receive rotatable drive element 12 therein as is described further herein.

Mounting member 24 has an exterior side 26 and an interior side 28. Rotatable drive element 12 connects to the interior side 26 and motor housing 18 connects to the exterior side 28. A collar 30 extends inwardly from the mounting member 24 thereby separating the interior side 28 from the exterior side 26. In the arrangement shown, collar 30 has a flat and flush interior side 32 which extends into the open interior of mounting member 24 perpendicularly to the interior surface of mounting member 24. The exterior side of collar 30 has a protrusion 34 that extends outwardly from collar 30 in perpendicular alignment to collar 30 and in parallel spaced alignment to the interior surface of mounting member 24 thereby forming channel 36 between the interior surface of mounting member 24 and the exterior surface of protrusion 34. A step 38 is positioned between protrusion 34 and the end 40 of collar 30 which defines a circular interior through hole. Step 38 and channel 36 serve to engage and hold motor housing 18 while allowing portions of the motor housing 18 to extend through the open end 40 of collar 30 to engage and rotate rotatable drive element 12 on the other side of collar 30.

As is shown, the features of the interior side 28 of mounting member 24 are generally circular in shape so as to allow rotation of rotatable drive element 12 therein. In contrast, key-features 42 are positioned in the exterior side 26 of mounting member 24 to prevent rotation of motor housing 18 connected thereto. Key-features 42 are any aberration, deviation, irregularity, or anomaly in the round features in the exterior side 26 of mounting member 24. Key-features 42 breakup the circular shape of the features in the exterior side 26 of mounting member 24 and thereby serve to prevent rotation of motor housing 18 when connected to bracket 16. In the arrangement shown, key-features 42 include a pair of semi-circular recesses 44 in the mounting member 24 that extend partially or all the way to the collar 30. A divider 46 extends partially between the two recesses 44 and provides separation thereto. Divider 46 is positioned in alignment with the center of extension arm 22 for added strength and ease of alignment.

Electrical contacts 48 are positioned in the key-features 42 at approximately the center of each recess 44 and extend outwardly from the exterior surface of collar 30 within channel 36. In the arrangement shown, electrical contacts 48 are circular spring loaded conductive plungers, however any other form of an electrical contact is hereby contemplated. Electrical contacts 48 are electrically connected to a conduit 50 which extends through a passageway 54 in extension arm 22 of bracket 16 and through a passageway 56 in mounting plate 20. Passageway 56 in mounting plate 20 is to the side of and intentionally separated from upper through hole 58 and lower through hole 60 so as to prevent conduit 50 from being damaged when mounting bracket 16. Through holes 58, 60 receive fasteners 62 (not shown), such as conventional screws which are used to attach brackets 16 to a wall, ceiling or other mounting structure. In the arrangement shown, the lower through hole 60 is positioned approximately in the lateral middle of mounting plate 20 whereas the upper through hole 58 is positioned laterally to one side of the mounting plate 20. This offset provides advantages during mounting, namely, a fastener 62 can be inserted in the bottom through hole 60 and then the bracket 16 can be rotated on the lower fastener 62 into place followed by a fastener 62 into the upper through hole 58 to complete installation.

The lower end of conduit 50 is connected to a socket assembly 64. Socket assembly 64 is any form of an electrical connector such as a USB port, a two-conductor socket, a three conductor socket, a four conductor socket, a five conductor socket, a six conductor socket, a phone jack, an Ethernet socket, or any other standard or non-standard socket used to connect conduit 50 to any other device or object electrically.

A components recess 66 is positioned in mounting plate 20 which is sized and shaped to receive a motor controller assembly 68, which is described further herein. Components recess 66 is formed of any suitable size, shape and design. As one example, in the arrangement shown, components recess 66 is positioned between the sidewalls 67 and front wall 69 of mounting plate 20 and positioned adjacent to the through holes 58, 60.

Motor Housing:

Motor housing 18 is connected adjacent the exterior end of rotatable drive element 12. Motor housing 18 is connected to the exterior side 26 of mounting member 24 of bracket 16. Motor housing 18 is formed of any suitable size and shape. In one arrangement, as is shown, motor housing 18 is formed of a hollow tube 70 which is formed as an extension of rotatable drive element 12 and with approximately the same exterior size, shape, diameter and appearance of the rotatable drive element 12, as well as continuous extension of guide structure 14 therein. In this arrangement, when motor housing 18 is connected to the end of rotatable drive element 12, the length of rotatable drive element 12 is relatively seamlessly extended as is the length of guide structure 14. In one arrangement, as is shown, rotatable drive element 12 connects to the interior side 28 of mounting member 24. In this arrangement, mounting member 24 hides or covers the seam between rotatable drive element 12 and motor housing 18. In this arrangement, the motor housing 18 remains stationary as rotatable drive element 12 rotates, as is further described herein.

Motor housing 18 has an exterior end 72 and an interior end 74. Positioned within the open interior compartment of hollow tube 70 between interior end 74 and exterior end 72 is a motor 76. Motor 76 is any form of a motor that converts electrical energy to mechanical energy and provides rotation and torque. In the arrangement shown, motor 76 is connected to a transmission 78. Transmission 78 is any form of a device that transmits rotation of motor 76 and gears it such as a gear box, a planetary gear box or the like. Transmission 78 transmits the rotation of motor 76 and converts into the desirable speed useful for the application. The transmission 78 helps to maximize the torque produced by the motor 76 while maximizing battery life. In one arrangement, the transmission 78 is known as a gearbox.

Transmission 78 is connected to a drive shaft 80 which extends outwardly from the interior end 74 of motor housing 18. Drive shaft 80 extends through motor end cap 82 which is connected to the interior end 74 of hollow tube 70.

Motor end cap 82 has a generally circular external ring 84 having an interior edge 86 and an exterior edge 88. Interior edge 86 connects to hollow tube 70 whereas the exterior edge 88 connects to mounting member 24 of bracket 16. A collar 90 extends inwardly from the ring 84 thereby separating the interior side 86 from the exterior side 88 and provides a mounting surface for mounting motor end cap 82 to the other components of motor housing 18. An opening 92 positioned in the collar 90 allows for the drive shaft 80 of transmission 78 to extend from the interior side 86 of motor end cap 82 to the exterior side 88 of motor end cap 82.

Key-features 94 are positioned in the exterior surface of motor end cap 82. Key-features 94 are any aberration, deviation, irregularity, anomaly in the generally round exterior surface of ring 84 of motor end cap 82. Key-features 94 breakup the circular shape of the motor end cap 82 and thereby serve to prevent rotation of motor housing 18 when connected to bracket 16. In the arrangement shown, key-features 94 include a pair of semi-circular protrusions that connect to one another. Key-features 94 extend from the exterior edge 88 of ring 84 to the collar 90 of motor end cap 82. A divider 96 extends partially between the two semi-circular protrusions and provides separation thereto. Divider 96 is positioned in alignment with the center of extension arm 22 for added strength and ease of alignment.

Electrical contacts 98 are positioned in the key-features 94 at approximately the center of each semi-circular protrusion, on the interior side of ring 84. Electrical contacts 98 extend outwardly from the exterior surface 88 of collar 90. Electrical contacts 98 are connected to electrical connectors 99 which extend through the motor end cap 82 and transmit the power received by electrical contacts 98 to the electrical components contained within motor housing 18. In the arrangement shown, electrical contacts 98 are circular spring loaded conductive plungers, however any other form of an electrical contact is hereby contemplated. Electrical contacts 98 are electrically connected to the motor 76 and motor controller assembly 68 as is described herein.

In the arrangement shown, a pair of fasteners 100 extend through the collar 90 and connect to the transmission 78, or any other component of the motor housing 18, thereby locking the two components together. A bearing 102 and motor coupler 104 is positioned over the drive shaft 80 held in place by a locking arrangement between motor coupler 104 connects and drive shaft 80. Motor coupler 104 has a rounded or angled nose 106 which tapers outwardly as it extends towards motor housing 18. The exterior periphery of motor coupler 104 adjacent motor housing 18 is formed in the shape of gears 108 or a gear tooth arrangement. That is, the external surface of motor coupler 104 near its base where motor coupler 104 connects to the motor housing 18. The gears 108 mesh with gears in or attached to the rotatable drive element 12 and serve to rotate rotatable drive element 12 when motor 76 and/or transmission 78 is rotated. The rounded or angled nose 106 eases alignment and insertion of the motor coupler 104 through bracket 16 and into the rotatable drive element 12. A shoulder 110 is positioned towards the motor housing 18 from gears 108 and nose 106 and extends outwardly past gears 108. Shoulder 110 serves as a stop for bearing 102 which is positioned around body 112 and held in place by clip 114.

In this arrangement, as motor 76 rotates, the drive shaft 80 of transmission 78 rotates which rotates motor coupler 104 which rotates bearing 102 within ring 84 of motor end cap 82. The exterior end of motor 76 is connected to a motor controller 68. In one arrangement, motor controller 68 includes all the components to control motor 76 and to control operation of the architectural covering 10 all positioned within the motor housing 18. In an alternative arrangement, some portions of the motor controller 68 are positioned within the motor housing 18 and other portions of the motor controller 68 are positioned within the bracket 16.

Motor controller 68 is any device which controls the operation of motor 76. In one arrangement, motor controller 68 is an electrical circuit board or PC board 116 which is electrically connected to a microprocessor 118 connected to memory 120, a receiver or transceiver 122 and an antenna 124. Microprocessor 118 is any programmable device that accepts analog or digital signals or data as input, processes it according to instructions stored in its memory 120, and provides results as output. Microprocessor 118 receives signals from receiver or transceiver 122 and processes them according to its instructions stored in its memory 120 and then controls motor 76 based on these signals. Memory 120 is any form of electronic memory such as a hard drive, flash, ram or the like. Antenna 124 is any electronic device which converts electric power into electromagnetic signals or electromagnetic waves, which are commonly known as radio waves or RF (radio frequency) (hereinafter collectively referred to as "electromagnetic signals" without limitation). Antenna 124 can transmit and/or receive these electromagnetic signals. In one arrangement these electromagnetic signals are transmitted via AM or FM RF communication, while any other range of RF is hereby contemplated such as 433 MHz or 908 MHz. In the arrangement shown, a meandering monopole antenna or fractal antenna is used; however any other form of an antenna is hereby contemplated. Antenna 124 is positioned adjacent the exterior end 72 of motor housing 18 so as to be in the best position to receive electromagnetic signals without interference. In the arrangement shown, antenna 124 is positioned just inside of end cap 126. In an alternative arrangement, antenna 124 is incorporated within end cap 126. In another arrangement end cap 126 is replaced with a decorative finial; or alternatively a decorative finial is connected to end cap 126.

To detect rotation and track the position of rotatable drive element 12, a sensor assembly 128 is connected to motor housing 18. Sensor assembly 128 is any form of a device which senses the rotation or position of architectural covering 10, such as reed switches, mechanical encoders, magnetic encoders, or the like. In one arrangement, as is shown, sensor assembly 128 includes a magnet wheel 130 connected to a secondary motor shaft 132 extending outwardly from the exterior end 72 of motor 76 such that when motor 76 rotates, secondary motor shaft 132 rotates, thereby rotating magnetic wheel 130. Positioned adjacent to magnet 130 is at least one, and as is shown two, Hall Effect sensors 134 positioned opposite one another. In this arrangement, Hall Effect sensors 134 are connected to PC board 116 adjacent magnet 130 which extends into an opening in PC board 116. This arrangement using Hall Effect Sensors 134 is more fully described in Applicant's related patent application entitled Low-Power Architectural Covering Ser. No. 61/811,650 filed on Apr. 12, 2013 which is fully incorporated by reference herein. However, any other sensor is hereby contemplated for use to detect rotation, movement or vibration of the rotatable drive element 12, such as vibration sensors, accelerometers reed switches, or the like.

Battery Tube Assembly:

A battery tube assembly 136 is connected to the architectural covering 10. Battery tube assembly 136 is formed of any suitable size, shape and design. As one example, in the arrangement shown, the battery tube assembly 136 includes an elongated hollow tubular member 138 which is sized and shaped to receive a stack of conventional batteries 140 therein within close and acceptable tolerances such as A, AA, B, C or D cell batteries. These batteries 140 can be inserted or held within battery tube assembly 136 by any means known in the art. In one arrangement, as is shown, the lower end of battery tube assembly 136 is closed by a battery end cap 142. The opposite, or upper end of battery tube assembly 136, is removeably and replaceably enclosed by a battery connector cap 144. Battery connector cap 144 is removeably and replaceably connected to battery tube assembly 136 by a key-slot 146 positioned in the elongated hollow tubular member which is in locking and mating communication with a protrusion in the battery connector cap 144. However, any other means of connecting battery connector cap 144 to elongated hollow tubular member 138 is hereby contemplated such as threads, a snap fit design, a button-lock design or the like. A transmission wire 146 which terminates in a plug 148 extends outwardly from battery connector cap 144 and transmits electricity to architectural covering 10. Plug 148 matingly and matchingly and removeably and replaceably connects to socket assembly 64 in mounting plate 20 of bracket 16.

A battery tube mounting bracket 150 is removeably and replaceably connected to the elongated hollow tubular member 138 and serves to mount and hold elongated hollow tubular member 138 therein. Battery tube mounting bracket 150 is formed of any suitable size, shape and design. As one example, in the arrangement shown, battery tube mounting bracket 150 is a generally elongated extrusion having a back wall 152 connected to its outward edges to sidewalls 154. The space between back wall 152 and opposing sidewalls 154 is sized and shaped to frictionally and tightly, but removeably, receive hollow elongated tubular member 138. To achieve this frictional engagement, the ends 156 sidewalls 154 angle or curve inward toward one another. In this arrangement, elongated hollow tubular member 138 can be forced within the space between sidewalls 154 and back wall 152; and elongated hollow tubular member 138 can be forced out of the space between sidewalls 154 and back wall 152. Elongated hollow tubular member 138 can be mounted within the vicinity of bracket 16 and motor housing 18 in either a vertical alignment (as is shown) in a perpendiculars alignment or in any other alignment by fastening battery tube mounting member 150 to the wall, ceiling or structure architectural covering 10 is mounted to. Mounting can be accomplished by passing conventional fasteners, such as screws or bolts, through the back wall 152 of battery tube mounting bracket 150.

Motor Coupler Sleeve:

Rotatable drive element 12 connects to the motor housing 18 through connection of the motor coupler 104 to a motor coupler sleeve 160. Motor coupler sleeve 160 is an elongated hollow tubular member having an exterior surface 162 and an interior surface 164 which extend in generally parallel spaced relation to one another. The exterior surface 162 has gears or teeth therein that extend along a length of motor coupler sleeve 160. The gears or teeth in the exterior surface 162 of motor coupler sleeve 160 matingly and meshingly and removeably and replaceably engage and receive gears or teeth in the interior surface 166 of rotatable drive element 12 adjacent its open hollow end 168. A collar 170, or protrusion positioned in the exterior surface 162 of motor coupler sleeve 160 sets the distance at which motor coupler sleeve 160 can be inserted into the end 168 of rotatable drive element 12.

The interior surface 164 of motor coupler sleeve 160 also has gears or teeth therein that extend along a length of motor coupler sleeve 160. The gears or teeth in the interior surface 164 of motor coupler sleeve 160 matingly and meshingly and removeably and replaceably engage and receive gears 108 in the interior surface of motor coupler 104 of motor housing 18. In this arrangement, nose 106 of motor coupler 104 is inserted through the mounting member 24 of bracket 16 and into the hollow interior of motor coupler sleeve 160 such that the gears 108 of motor coupler 104 engage the teeth or gears in the interior surface 164 of motor coupler sleeve 160. A collar 170, or protrusion positioned in the exterior surface 162 of motor coupler sleeve 160 sets the distance at which motor coupler sleeve 160 can be inserted into the end 168 of rotatable drive element 12.

When motor coupler sleeve 160 is fully inserted within the hollow interior end 168 of rotatable drive element 12 and the motor coupler 104 is fully inserted into the hollow interior of motor coupler sleeve 160, rotation of motor coupler 104 causes rotation of rotatable drive element 12.

Center Coupler:

Two rotatable drive elements 12 can connect to one another in end-to-end alignment through the use of a center coupler 172. The use of multiple center couplers 172 can be used to connect two, three, four or more rotatable drive elements 12 together without limit.

Center coupler 172 is formed of any suitable size, shape and design. As one example, in the arrangement shown, center coupler 172 is a pair of elongated hollow tubular members 174 connected at their inward facing edge to a bearing assembly 176. In one arrangement, bearing assembly 176 includes an individual bearing 178 associated with each elongated hollow tubular member 174. The exterior surface 180 of each elongated hollow tubular member 174 has gears or teeth therein that extend along a length of each elongated hollow tubular member 174. The gears or teeth in the exterior surface 180 of elongated hollow tubular member 174 matingly and meshingly and removeably and replaceably engage and receive gears or teeth in the interior surface 166 of rotatable drive element 12 adjacent its open hollow end 168.

In one arrangement, bearing assembly 176 allows for free and independent rotation of each elongated hollow tubular member 174 of center coupler 172 without affecting the other. This allows for rotation of two rotatable drive elements 12 free and independent of one another. This allows for individual control and operation of one side of architectural covering 10, such as when two motor housings 18 are associated with a two rotatable drive element 12 architectural covering 10, where each motor housing 18 controls only the rotatable drive element 12 it is connected to.

In an alternative arrangement, the two elongated hollow tubular members 174 are connected to one another, or only a single elongated hollow tubular member 174 is used. In this arrangement, the rotatable drive elements 12 do not rotate independently of one another. When two motor housings 18 are used with this arrangement, additional torque is provided by the combined force of two motors 76.

In one arrangement, the elongated hollow tubular members 174 are inserted all the way into the open ends 168 of rotatable drive elements until the ends 168 engage or approximately engage the bearing assembly 176. In this arrangement, rotatable drive elements are fully inserted over center coupler 172. In one arrangement, when fully inserted into opposing rotatable drive elements 12 no further support is necessary. In an alternative arrangement, center coupler 172 is connected to a bracket 16. That is, the bearing assembly 176 is held within the mounting member 20 of a bracket 16. When bearing assembly 176 is positioned within mounting member 20 of a bracket 16, rotatable drive elements 12 are free to rotate upon bearings 178. In this way, additional support is provided while still allowing for necessary rotation.

The center coupler 172 provides for easier installation by allowing the assembly of long rotatable drive elements 12 from shorter rotatable drive elements 12. This also reduces the cost and complexity of shipping. In addition, in one arrangement, elongated hollow tubular members 174 of the center coupler 172 are formed of a material that has some give or bend to it. Suitable materials include plastic, rubber, composite UHMW material or the like. The benefits of this material, used in association with the hollow design of the tubular members 174 allow the center coupler 172 to provide some give to the two rotatable drive elements 12. This give or ability to slightly bend allows for the combined rotatable drive elements 12 to be installed on walls or in applications that are not exactly perfectly straight, or allows for less-precise alignment during installation. In one arrangement, motor coupler sleeve 160 is also made of the same material which allows for less-precise installation of motor housing 18 into motor coupler sleeve 160. The use of one of these plastic or composite materials also serves to reduce noise of the architectural covering 10 during use.

Multiple center couplers 170 can be used to connect any number of rotatable drive elements together.

Rotatable Drive Element Extension:

In the arrangement shown in FIG. 1, only a single motor housing 18 is connected to the two rotatable drive elements 12, which drives the combined rotatable drive elements 12. A rotatable drive element extension 182 is connected to the exterior side 26 of the mounting member 14 of the second bracket 16. Rotatable drive element extension 182 is formed of any suitable size, shape and design. As one example, in the arrangement shown, rotatable drive element extension 182 is simply a dummy motor housing lacking the internal drive components such as the motor 76, transmission 78 and motor controller assembly 68 and the like. In one arrangement, in all other ways, rotatable drive element extension 182 has an identical appearance and design to motor housing 18 described herein. In this arrangement, rotatable drive element extensions 182 includes the hollow tube 70, motor end cap 82, bearing 102 and motor coupler 104 so as to connect rotatable drive element 12 and allow rotation thereof. Motor housing 18 and rotatable drive element extension 182 are secured to brackets 16 by a locking-screw 184 which extends through mounting member 24 and engages the motor end cap 82 of motor housing 18 or rotatable drive element extension 182 after installation. Locking-screw 184 prevents the motor housing 18 or the rotatable drive element extension 182 from falling out of bracket 16. In this way, the end 168 of rotatable drive element 12 connected to the motor housing 18 is identified as the motor-side; whereas the end 168 of rotatable drive element 12 connected to the rotatable drive element extension 182 is identified as the non-motor side.

Idler Attachment Elements:

Idler attachment elements 186 are connected to and positioned around rotatable drive element 12. Idler attachment elements 186 are formed of any suitable size and shape. In one arrangement, as is shown, idler attachment elements 186 are formed of a circular hoop member 188 which is sized and shaped to fit loosely around rotatable drive element 12. In one arrangement, a mounting ring 190 is connected to the circular hoop member 188 for attachment of shade material 192 which hangs down from idler attachment elements 186 and drive attachment elements 194.

Drive Attachment Elements:

Drive attachment elements 194, like idler attachment elements 186 are connected to and positioned around rotatable drive element 12. A single drive attachment element 194 is positioned outside of, or at the end of the row of idler attachment elements 186. Alternatively, a single idler attachment element 186 is positioned inward of the drive attachment element 194. This arrangement helps to keep the shade material 192 from hanging vertically, and helps to resist the drive attachment element from rotating around the rotatable drive element 12.

Drive attachment elements 194 is formed of any suitable size, shape and design. In one arrangement, as is shown, drive attachment element 194 has a generally circular shape fit over and receives rotatable drive element 12 with a tooth engaged in the guide structure 14 such that when the rotatable drive element 12 rotates the drive attachment element 194 is driven along the length of rotatable drive element 12.

The idler attachment elements 186 and the driver attachment elements 194 are more fully described in applicant's related patent application Ser. No. 61/810,949 entitled Rotatable Drive Element For Moving A Window Covering Including A Flexible Guide Arm And A Pointed Tooth Arrangement filed on Apr. 11, 2013 which is fully incorporated by reference herein along with any related patent applications.

Assembly:

The architectural covering 10 is assembled by connecting the opposing rotatable drive elements 12 by fully inserting the elongated hollow tubular members 174 of center coupler 172 into the open end 168 of each rotatable drive element 12 until each bearing 178 is adjacent the end 168 of rotatable drive element 12. Bearing assembly 176 may or may not be connected to a mounting member 24 of a center bracket 16 to provide additional support at the middle of combined rotatable drive element 12. In addition, motor coupler sleeves 160 are fully inserted in the open outward ends 168 of rotatable drive elements 12 until collar 170 engages the end 168 of each rotatable drive element 12.

Once the two rotatable drive elements 12 are combined and assembled, the location of the non-motor side bracket 16 of the architectural covering 10 is established by aligning the center of center coupler 172 with the center of the window or other structure architectural covering 10 is intended to cover. Alternatively, by the location of the bracket 16 of the non-motor end of the architectural covering 10 is established by measuring from the center of the desired application outwardly based on the length of the rotatable drive element 12. Once the location of bracket 16 of the non-motor end of the architectural covering 10 is located, the rotatable drive element 12 is removed and the non-motor side bracket 16 is installed with a fastener 62 inserted through the through holes 60, 62.

Once the non-motor side bracket 16 is installed, using the combined rotatable drive element 12 as a guide, the location of the motor-side bracket 16 is established. This is accomplished by inserting the end 168 of the non-motor side of drive element 12 into the recess of the interior side 28 of non-motor side bracket 16. Next, the recess of the interior side 28 of motor-side bracket 16 is installed over the motor-side end of rotatable drive element 12. In this way the position of the motor-side bracket 16 is located and the rotatable drive element 12 is removed to allow for installation of the second bracket 16.

Once the location of the motor-side bracket 16 is established, a fastener 62 is inserted into the lower through hole 60 of mounting plate 20, also known as the cantilever hole. Once the lower fastener 62 is inserted into the second bracket 16, the bracket 16 can rotate or cantilever thereon. Next, the non-motor end 168 of rotatable drive element 12 is again inserted into the non-motor side bracket 16. Next, the motor-side end of the rotatable drive element 12 is aligned with and inserted into the mounting member 24 of motor-side bracket 16 by rotating bracket 16 upon fastener 62. Once the motor-side bracket 16 is aligned with the rotatable drive element 12, the second fastener 62 is fastened into through hole 58 and thereby the installation of the opposing brackets 16 is complete.

Next, the motor housing 18 and rotatable drive element extension 182 are connected to the exterior sides 26 of mounting members 24 of brackets 16. This is accomplished by aligning the key features 94 in the motor housing 18 and rotatable drive element extension 182 with the key features 42 of brackets 16. Once aligned, the motor housing 18 and rotatable drive element extension 182 are forced into tight frictional engagement with brackets 16 with the key-features 42, 94 in mating alignment and engagement with one another. In this position, the electrical contacts 98 of motor housing 18 are in electrical engagement with the electrical contacts 48 of motor-side bracket 16. Once the motor housing 18 and rotatable drive element extension 182 are fully inserted into or onto brackets 16, locking-screw 184 is tightened thereby ensuring motor housing 18 and rotatable drive element extension 182 do not accidently separate from bracket 16.

Next, battery tube assembly 136 is installed by fastening battery tube mounting bracket 150 to a wall, ceiling or other structure, preferably behind the stack of shade material adjacent the motor-side bracket 16. Once the bracket 150 is installed, the elongated tube 138 is forced into the bracket 150 and the plug 148 is engaged into the socket assembly 64 thereby electrically connecting the power of batteries 140 to the components of motor housing 18.

Figure 2:
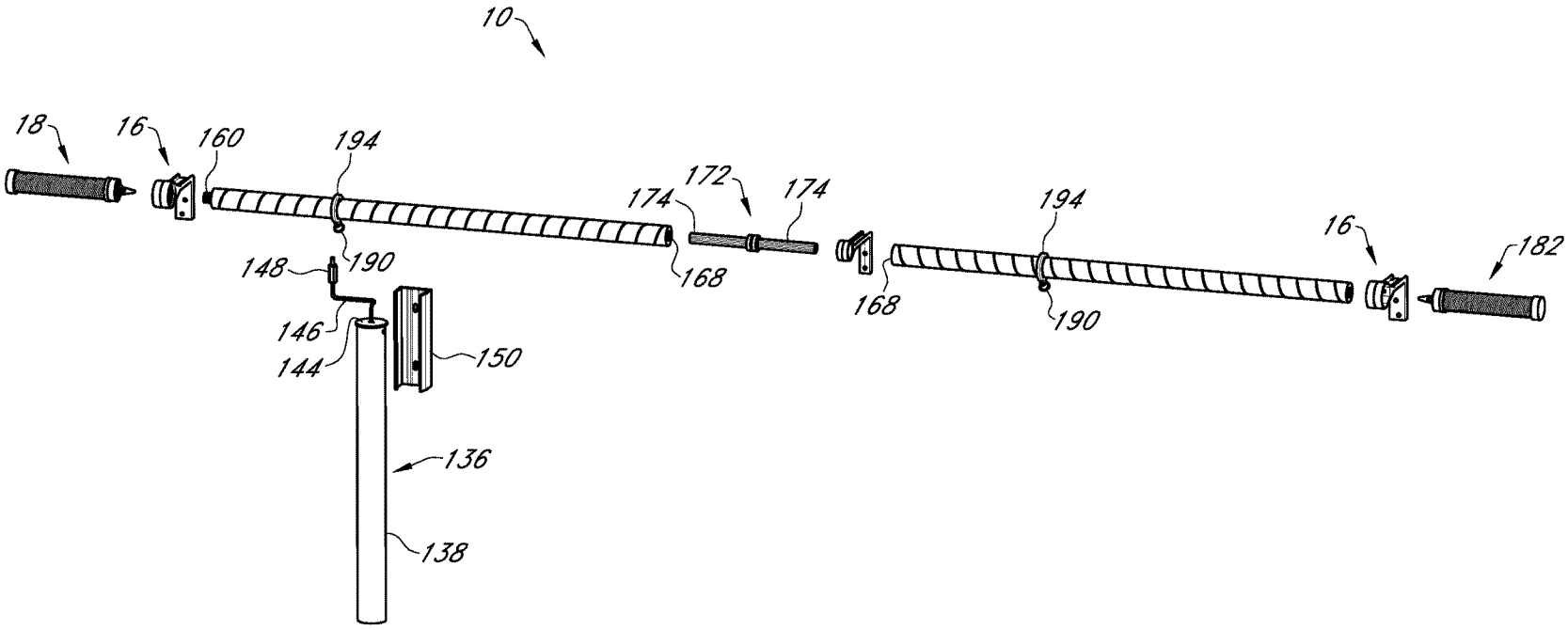
FIG. 2 is a perspective exploded view of the elements shown in FIG. 1
Figure 3:
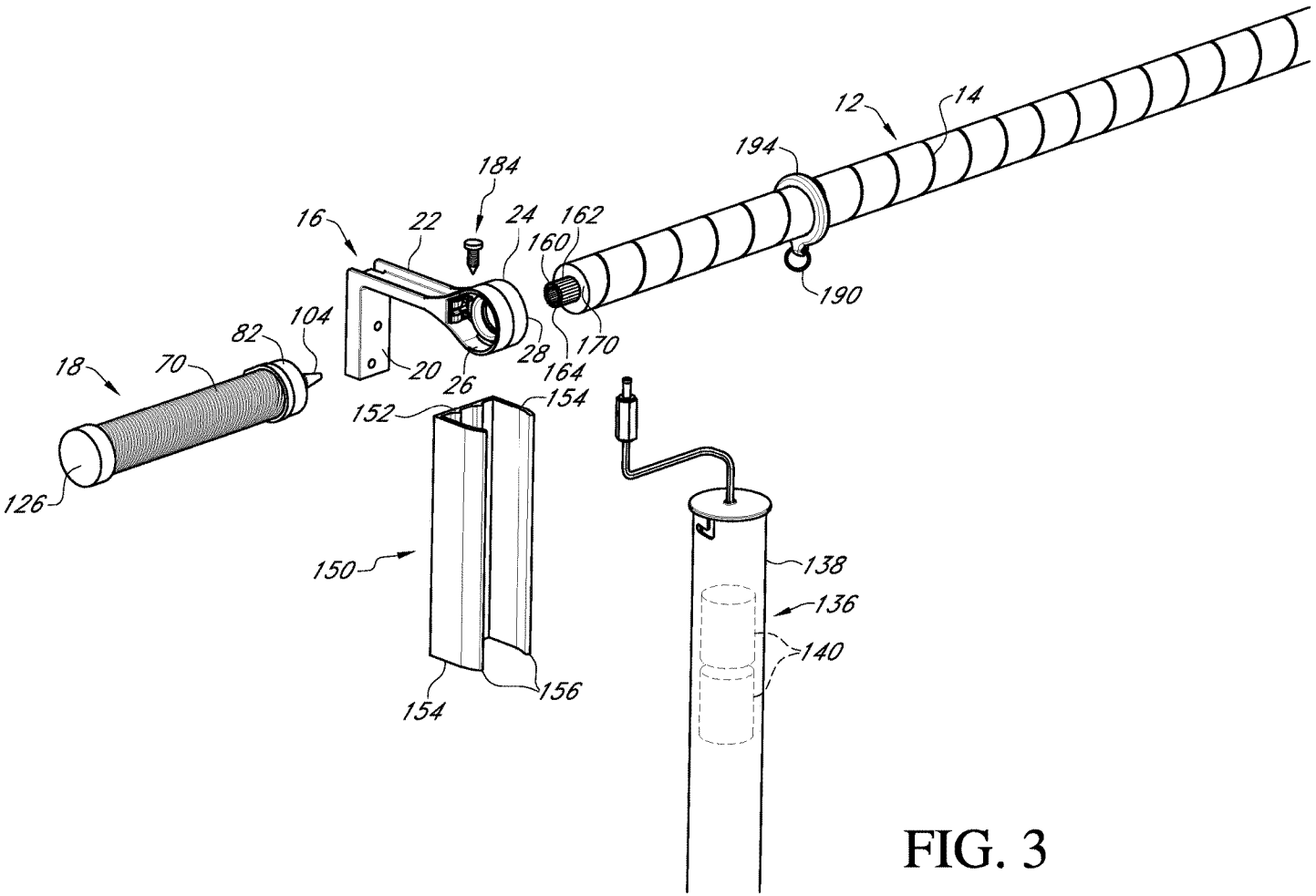
FIG. 3 is a close-up perspective exploded view of FIG. 2 showing the motor housing, bracket having a key feature and electrical contacts, a motor coupler sleeve positioned within the outward end of the rotatable drive element.
Figure 4:
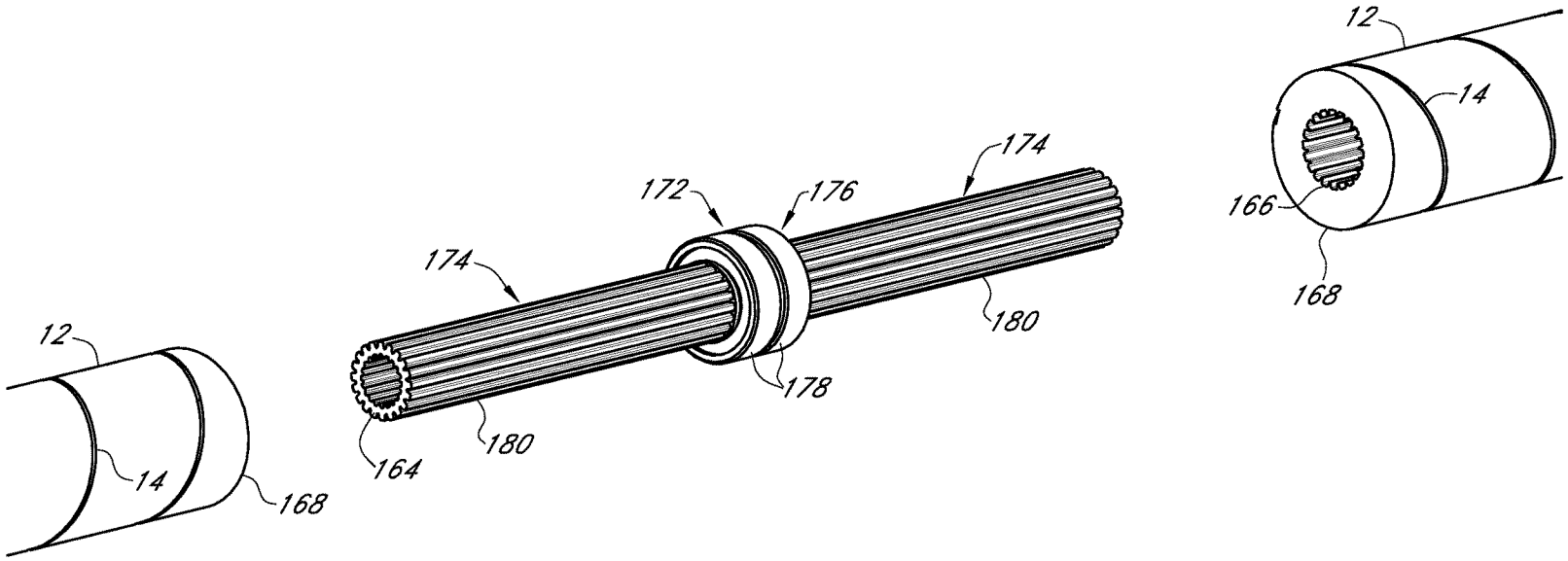
FIG. 4 is a close-up perspective exploded view of FIG. 2 showing the center coupler and the ends of rotatable drive elements.
Figure 5:
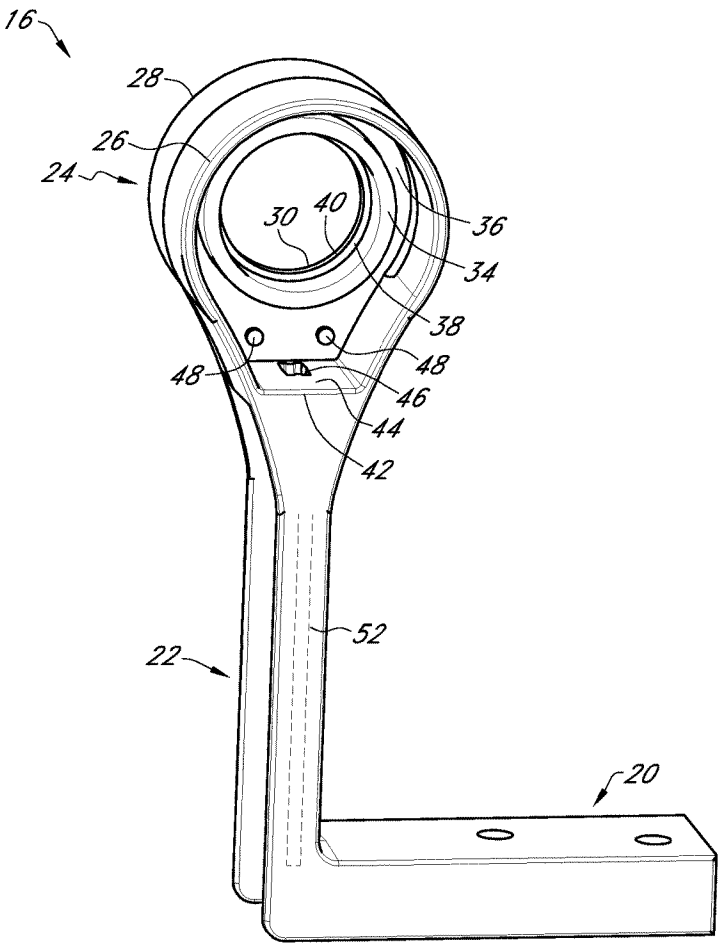
FIG. 5 is a close-up perspective view of a bracket which connects a motor housing to a rotatable drive element, the view showing the side which engages a motor housing, the view showing the key feature and the electrical contacts.
Figure 6:
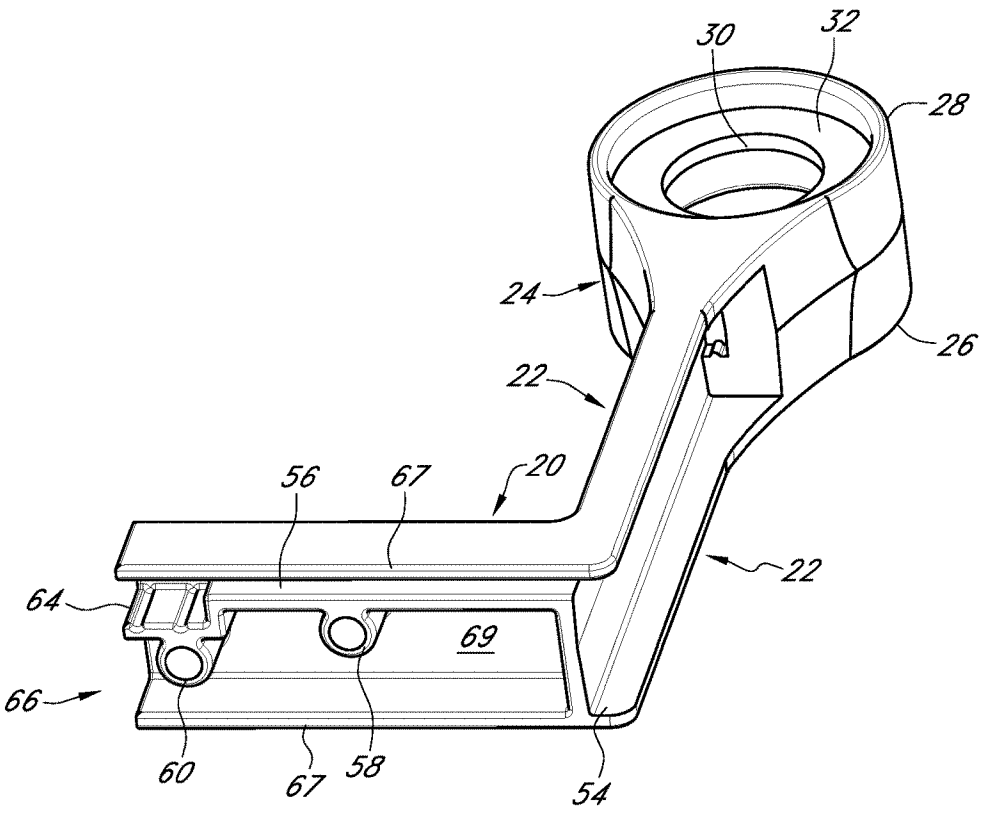
FIG. 6 is a close-up perspective view of a bracket which connects a motor housing to a rotatable drive element, the view showing the side of the bracket which engages a rotatable drive element, the view also showing the electrical socket and passageway, as well as a cavity which provides a spot for mounting and housing electronics for controlling the motor housing.
Figure 7:
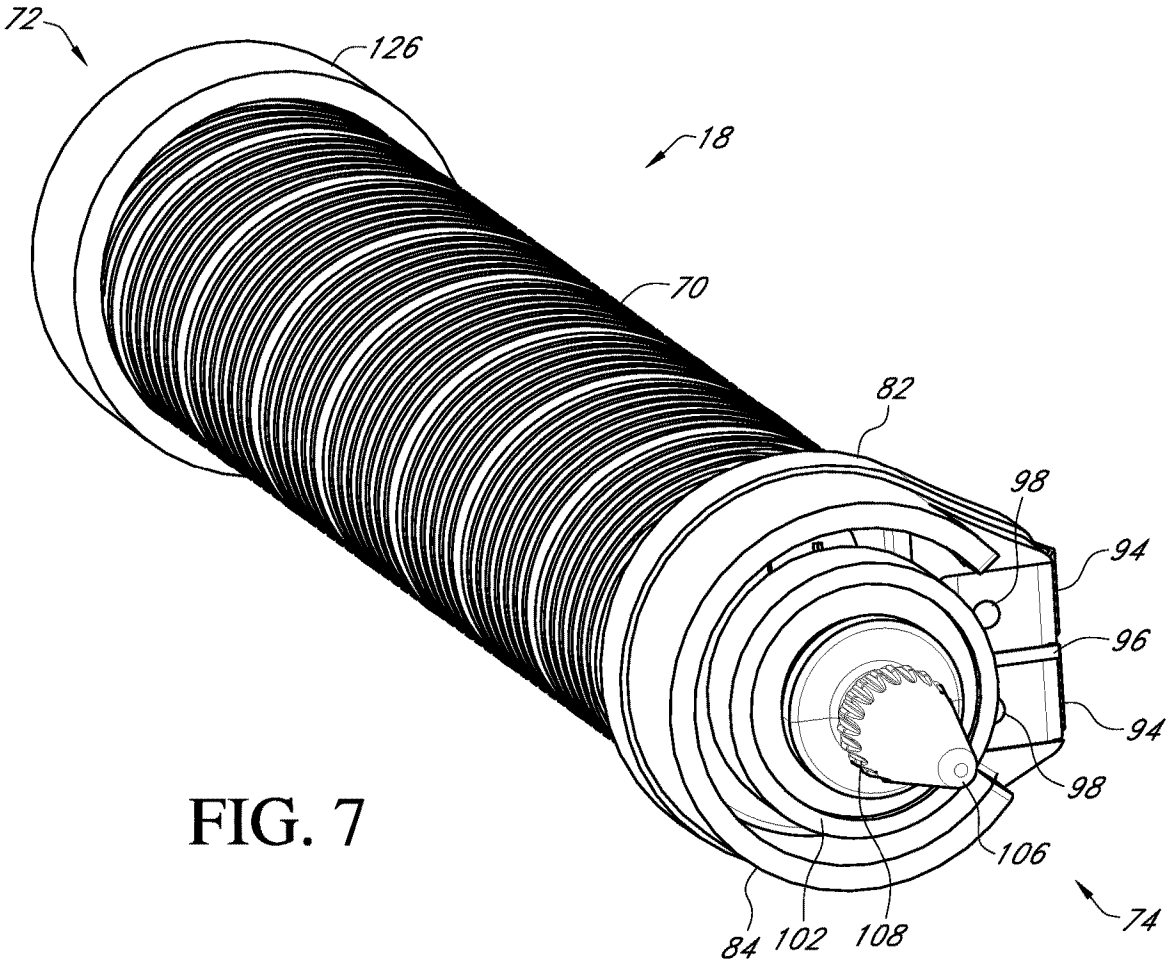
FIG. 7 is a close up perspective exploded view of a motor housing showing a threaded surface structure, an exterior end cap, a bearing a motor coupler a motor end cap and a key feature having electrical contacts.
Figure 8:
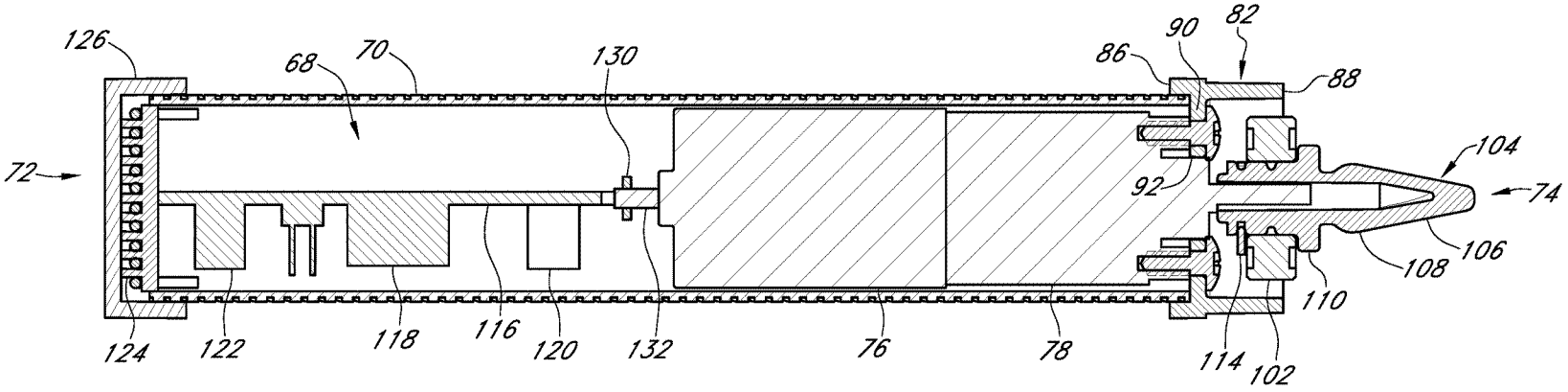
FIG. 8 is side elevation cut-away view of the motor housing shown in FIG. 7, the view showing the motor coupler, bearing, planetary gear box, electrical motor, sensor assembly, motor controller assembly, and antenna.
Figure 9:
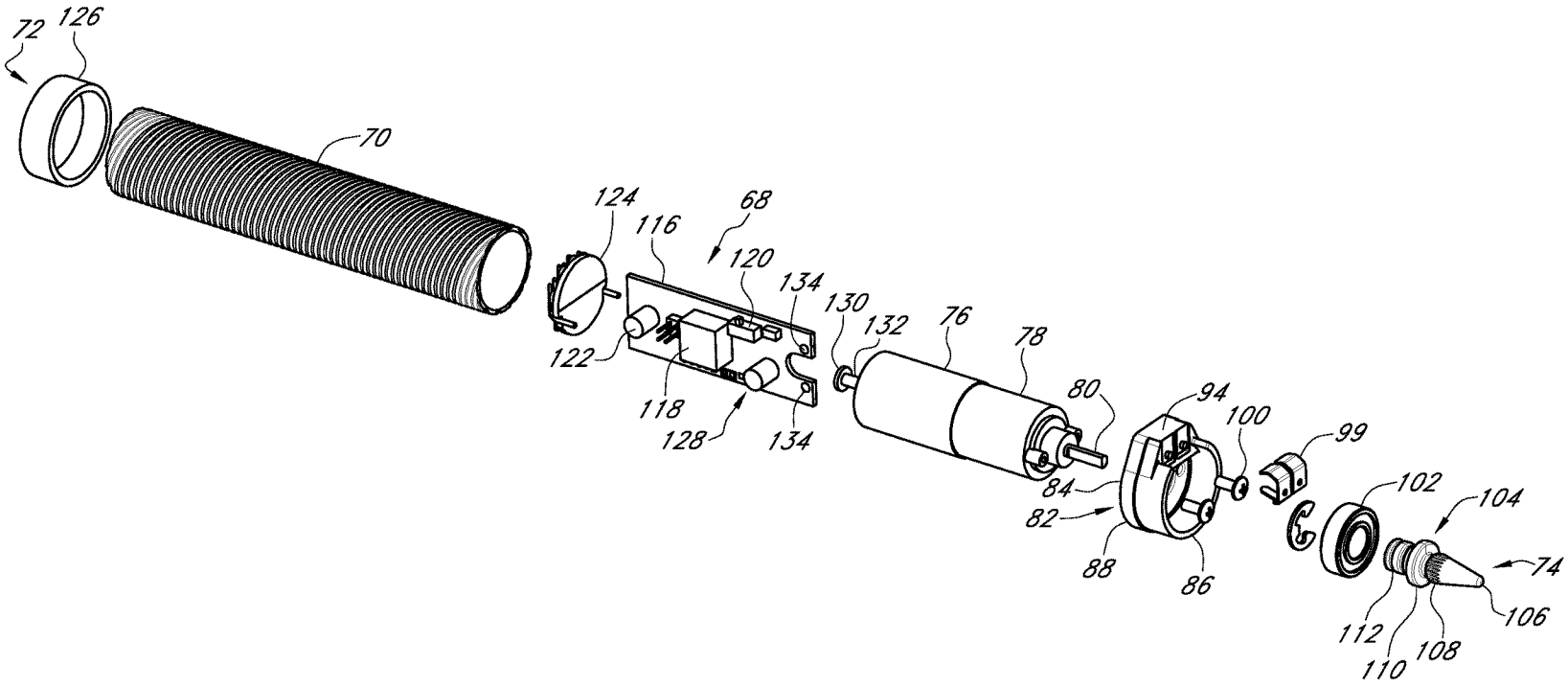
FIG. 9 is an exploded perspective view of the motor housing shown in FIG. 7, the view showing the motor coupler, bearing, planetary gear box, electrical motor, sensor assembly, motor controller assembly, antenna motor end cap and exterior end cap.
Figure 10:
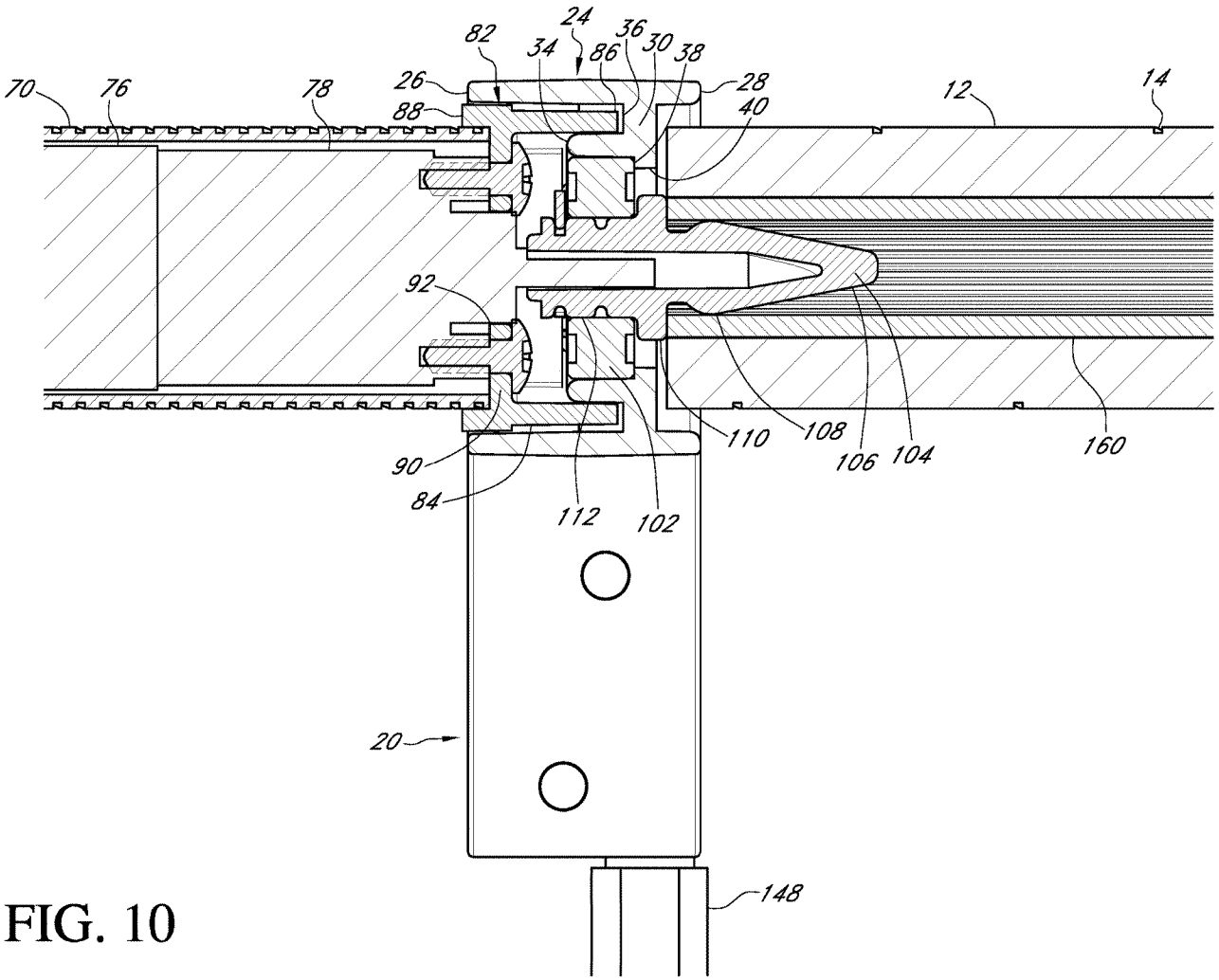
FIG. 10 is side elevation cut-away view of the motor housing shown in FIG. 7 connected to a rotatable drive element through a motor bracket, the view showing the motor coupler, bearing, planetary gear box, electrical motor, electrical plug and rotatable drive element.

In Operation—Single Motor Assembly:

In the arrangement wherein only a single motor housing 18 is connected to the combined rotatable drive element 12 (such as is shown in FIGS. 1 & 2), the single motor housing 18 rotates both rotatable drive elements 12. In this arrangement, the motor housing 18 is installed on the left bracket 16 and locked in place by the mating engagement of key-features 42, 94 as well as the engagement of locking-screw 184, which prevents rotation of motor housing 18 when motor 76 rotates. With motor coupler 104 inserted into the motor coupler sleeve 160, as motor 76 rotates, the components of transmission 78 rotate which rotates drive shaft 80 which rotates motor coupler 104 on bearing 102. This rotation is transferred through the motor coupler sleeve 160 and thereby rotates the first rotatable drive element 12. The rotation of the first rotatable drive element 12 is transferred through center coupler 172 to rotate the second rotatable drive element 12. The end opposite motor housing 18 of the second rotatable drive element 12 rotates freely upon bearing 102 and is supported by the right bracket 16. In this way, a single motor housing 18 rotates dual rotatable drive elements 12. In this arrangement, when the center coupler 172 is supported by a bracket 16, the bearings 178 allow free rotation of the rotatable drive elements 12 within the mounting member 24 of the bracket 16.

Activation:

In this arrangement, motor 76 of architectural covering 10 can be actuated in any one of a plurality of methods and manners. Motorized control of architectural covering 10 can be implemented in several ways. As examples, the motor 76 can be actuated by tugging on the architectural covering 10, by using a remote control device using RF communication, by using a voice command and a voice command module, an internet enabled application, or any other method.

Tugging, Tapping & Sliding:

One method of actuating the motor 122 is through tugging, tapping or sliding. This method and system is more fully described in Applicant's related patent application entitled Low-Power Architectural Covering Ser. No. 61/811,650 filed on Apr. 12, 2013 which is fully incorporated by reference herein. A tug is defined a small manual movement of the architectural covering. This tug is sensed by a tug sensor or the sensor assembly 128 such as an accelerometer, hall-effect sensors 134, reed switch or the like as is more fully described in Applicant's related patent applications. When the tug sensor senses the tug, the system is woken up from a sleep state. In sleep state, power use is minimized to maximize battery life. When the system is woken up, the tug sensor senses the tug and the Microprocessor 118 deciphers the tug and determines how to actuate the motor 76.

In one arrangement, the microprocessor 118 is programmed to recognize, one, two, three, or more tugs separated by a predetermined amount of time, such as between a quarter second and one and a half seconds. However any other amount of time between tugs is here by contemplated such as ¼ second, ½ second, ¾ second, 1 second, 1&¼ seconds, 1&½ seconds, 1&¾ seconds, 2 seconds, and the like. When microprocessor 118 detects a single tug, pursuant to instructions stored in the memory 120 microprocessor 118 instructs motor 76 to go to a first corresponding position, such as open. When microprocessor 118 detects two tugs, pursuant to instructions stored in memory 120, the microprocessor 118 instructs motor 120 to go to a second corresponding position, such as closed. When microprocessor 118 detects three tugs, pursuant to instructions stored in memory 120 microprocessor 118 instructs motor 122 to go to a third corresponding position, such as half open. Any number of tugs and positions can be programmed.

In an alternative arrangement, a wand or other device is connected to the rotatable drive element 12 and/or shade material 192. In this arrangement, the wand is used to tap the rotatable drive element 12. This causes vibrations to extend through the rotatable drive element 12 which are sensed by sensor assembly 128. In this arrangement, the sensor assembly 128 is tuned to recognize the high frequency vibrations associated with a tap and when it does, it rotates the rotatable drive element 12 in the opposite direction of the last movement.

In yet another alternative arrangement, the sensor assembly 128 is tuned to sense a slide of the idler attachment elements 186 across the rotatable drive element 12. That is, to activate the rotation, the user tugs a portion of the shade material 192 laterally, thereby causing the idler attachment elements 186 to slide across the rotatable drive element 12. As the idler attachment elements engage the guide structure 14 this sends vibrations through the rotatable drive element 12. The sensor assembly 128 is tuned to sense these vibrations and when it does, it rotates the rotatable drive element 12 in the opposite direction of the last movement.

Remote Control and Voice Control Operation:

One method of activating the motor 76 is through using a wireless remote 196. This method and system is more fully described in Applicant's related patent application entitled System and Method for Wireless Voice Activation of Motorized Window Coverings Ser. No. 61/807,846 filed on Apr. 3, 2013 which is fully incorporated by reference herein. In that application, as is contemplated herein, a wireless remote 196 is activated by the user, by pressing a button. When activated, the wireless remote 196 transmits an electromagnetic signal over-the-air, which is received by the antenna 124 of the motor controller assembly 68. Once antenna 124 receives the electromagnetic signal it is transmitted to receiver or transceiver 122 which converts the signal and transmits it to microprocessor 118. Microprocessor 118 interprets the signal based on instructions stored in memory 120 and actuates the architectural covering 10 to the predetermined position. As is also presented in that application, is a voice activation module 198, which receives a user's voice command, converts it to an electromagnet signal which is received by architectural covering 10 in the same manner described.

Internet Control and Operation:

One other method of actuating the motor 76 is through use of the internet and use of an electronic device. This method and system is more fully described in Applicant's related patent application entitled System and Method for Wireless Communication With and Control of Motorized Window Coverings Ser. No. 61/807,804 filed on Apr. 3, 2013 which is fully incorporated by reference herein. In that application, as is contemplated herein, motor 76 is actuated by a user having an internet enabled handheld device, such as a laptop, tablet or smartphone, which transmits a signal through the internet which is received at a gateway which then transmits an electromagnetic signal to the architectural coverings 10 as is described herein.

In Operation—Dual Motor Assembly:

In the arrangement wherein a motor housing 18 is connected to both ends of the combined rotatable drive element 12 there are two modes of operation. The first mode of operation includes where the center coupler 172 does not allow for independent rotation of rotatable drive elements 12. In this arrangement, the two motor housings 12 combine to contribute to the rotation of the combined rotatable drive elements 12. In this arrangement, a benefit is that the two motor housings 18 provide additional power and torque for the application. In this arrangement, a drawback is that the two motor housings 18 should be actuated simultaneously and be tuned to operate in cooperation with one another, otherwise one motor housing 18 will be working against the other.

In an alternative arrangement, center coupler 172 allows for independent rotation of rotatable drive elements 12 upon bearings 178. In this arrangement, a single motor housing 18 only rotates a single rotatable drive element 12. This eliminates coordinating opposing motor housings 18 as one will not affect the other. This also provides for independent opening/closing of one side of the architectural covering 10 while leaving the opposing side unaffected.

Coordination of Dual Motor Housings:

In the arrangement wherein two motor housings 18 are used, coordination of the two motor housings 18 may be desired. That is, in some applications it is desirable to turn on and turn off motors 76 at the same time. In other applications it is also important to rotate the motors 76 at the same speed. There are multiple ways to accomplish this coordination. In one arrangement, the two motor housings 18 are connected by an electrical conduit, such as a wire, which transmits control signals from one motor housing 18 to the other motor housing 18. More specifically, the two motor controller assemblies 68 are connected to one another and communicate with one another. This ensures that when one motor housing 18 receives a control signal, such as through a tug, tap or slide or through a wireless or electromagnetic signal, that the control signal is relayed to the other motor housing 18. This ensures when one motor housing 18 receives a control signal so does the other motor housing 18.

In another arrangement, the two motor housings 18 are wirelessly connected to one another. In this arrangement, the motor controller assemblies 68 of each motor housing 18 have a transceiver 122, instead of a receiver, which allows for sending as well as receiving control signals. In this arrangement, when a control signal is received by one motor controller assembly 68, the transceiver 122 re-broadcasts or relays the control signal which is received by the transceiver 122 of the other motor controller assembly 68. In this way, the two motor controller assemblies 68 communicate with one another to ensure the control signals have been received by both motor controller assemblies 68.

Additional information is also transmitted from motor housing 18 to motor housing 18 in the ways described herein, such as wirelessly or through wired communication. This information can include as speed, location, state (such as awake or asleep mode) and the like so as to coordinate operation and actuation of the two motors 76.

Conductive Brackets:

In one arrangement, the brackets 16 are formed of a conductive material such as steel, copper, aluminum, an alloy or the like. In this arrangement, the bracket 16 can itself be used as a pathway or conductor for carrying electricity from battery tube assembly 136. In this way, when plug 148 connects to socket assembly 64 a conduit 50 or wire can be eliminated because this conduit 50 has been replaced by the bracket itself. This reduces cost of the system and eases the assembly by eliminating a part.

Components Recess:

In one arrangement, the motor controller assembly 68, or a portion thereof is positioned within a portion of a bracket 16. In one arrangement, the motor controller assembly 68, or a portion thereof is positioned within the components recess 66 of bracket 16. In this arrangement, all the necessary components for controlling motor 76 are positioned within the bracket 16. As one example, antenna 124, receiver or transceiver 122, memory 120 and microprocessor 118 are positioned within components recess 66 of bracket 16. This arrangement allows for a smaller motor housing 18 which improves the aesthetic appearance of design.

Knurling:

In one arrangement, guide structure 14 can be formed into the exterior surface of the rotatable drive elements 12, motor housings 18 and rotatable drive element extensions 182. Knurling is a method used to cut or roll a pattern onto a material such as plastic or metal. This process is typically performed on a lathe, though in some cases a hand knurling tool will be used instead. A knurled object may have a threaded, diamond, crisscrossed, or straight line pattern imparted on it that adds both functionality and pleasing aesthetics. Knurling is often meant to provide a better gripping surface than offered by the bare material.

The primary method used to knurl objects is a lathe process that uses a very hard roller to press the desired shape into the work material. A roller with a reverse imprint of the desired knurl is held in a knuckle or jig and then pressed into the piece being worked on. The main configurations used for this type of knurling contain either one or two rollers. A straight knurl can be pressed by one roller, but any type of a diamond or crisscrossed design will require rollers with opposing patterns. The drawback of this process is that the rollers need to be matched to the unique outer diameter of each workpiece, so it is best for the mass production of many identical components.

Figure 11:
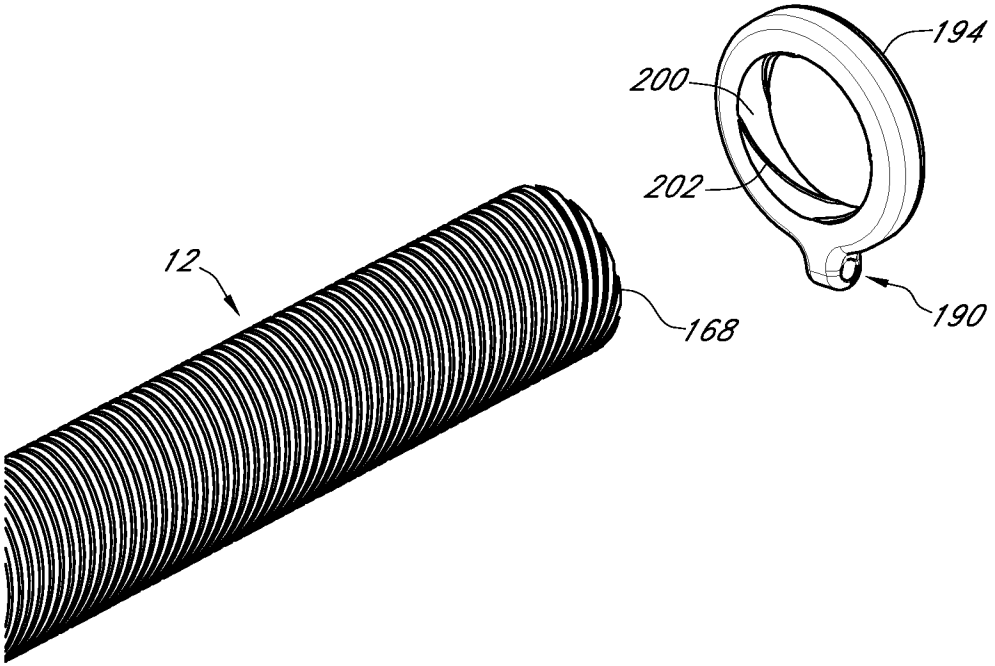
FIG. 11 is a perspective view of a rotatable drive element having a threaded surface and a driver attachment element showing a lower density of teeth on the interior surface of the driver element than the number of threads in the surface of the rotatable drive element.
Figure 12:
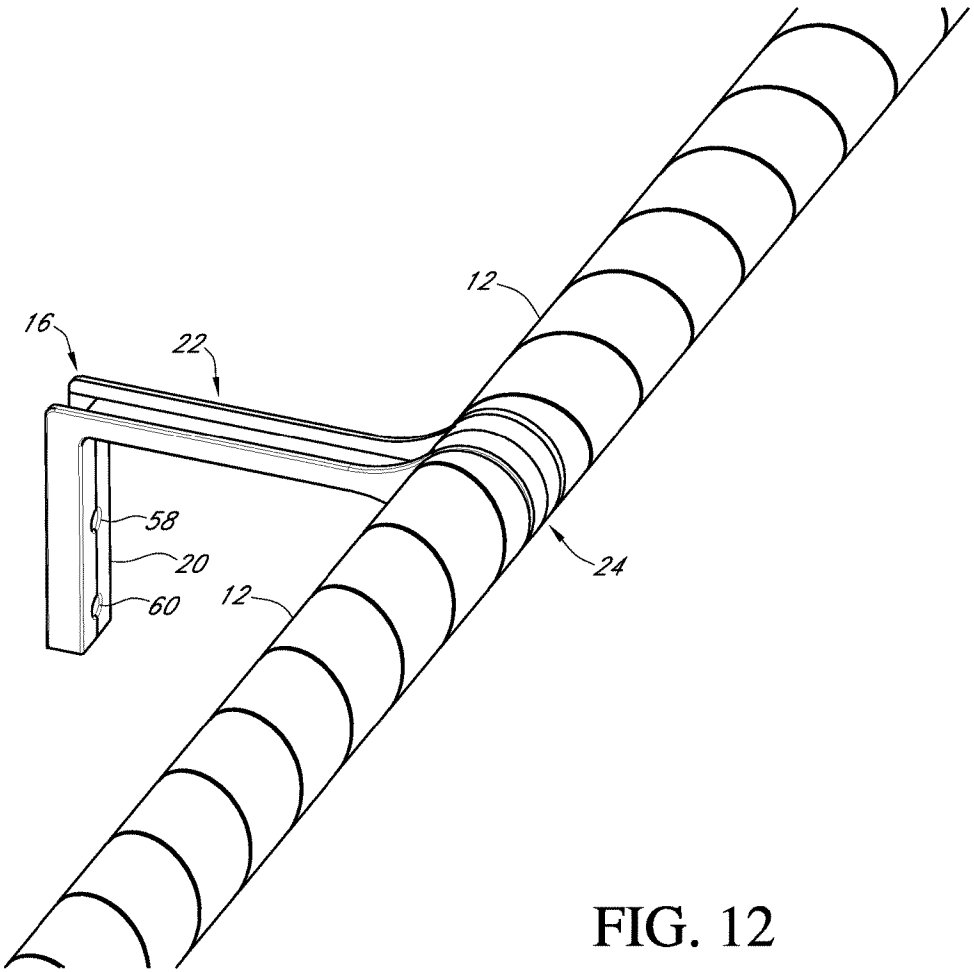
FIG. 12 is a perspective view of the rotatable drive elements connected together at a center bracket, the center coupler being positioned within the bracket and the open interior of the rotatable drive element.
Figure 13:
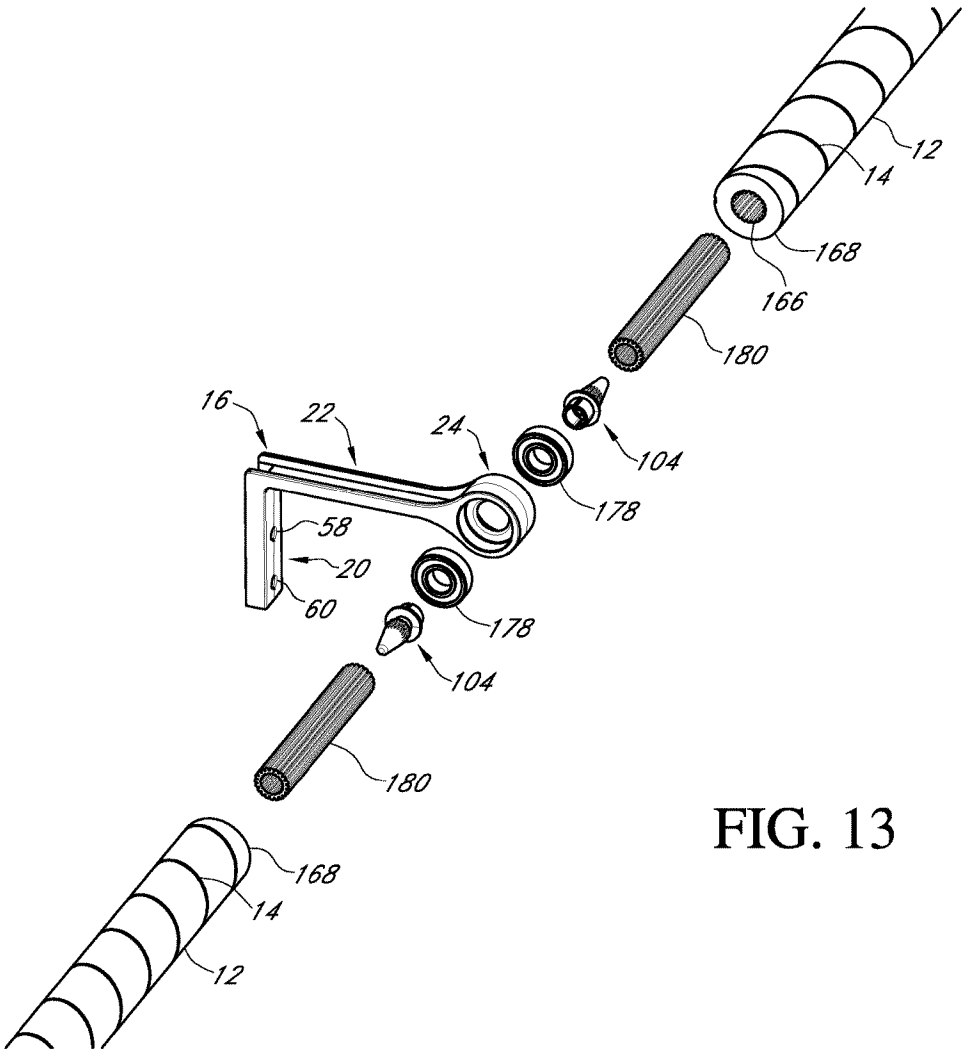
FIG. 13 is a perspective exploded view of FIG. 12.

In the arrangement shown in FIG. 11, a threaded surface is knurled into the surface of rotatable drive elements 12. Knurling is a fast, inexpensive, durable, accurate and efficient method of imparting the guide structure 14 into the surface of the rotatable drive element 12. An example of the knurled surface imparted into the surface of rotatable drive element 12 is shown in FIG. 11 which is a diamond shaped pattern, a crisscrossed pattern or a cross-threaded pattern. This pattern shows a high-density of threads which extend in a left-hand-rotation as well as a right-hand-rotation. This pattern also shows an extremely high-density of threads. Knurling is a desirable process because to impart this amount of threads in the surface of a rotatable drive element 12 by any other process would be extremely complicated and extremely time consuming.

Drive attachment element 194 engages the threaded and cross threaded pattern of the knurled surface. The interior surface 200 of drive attachment element has a tooth 202 that matingly engages the threads of the knurled pattern. As the rotatable drive element 12 is rotated, the tooth 202 of the drive element 12 rides along in the recesses or threads of the knurled surface which, depending on the direction of rotation, drives the drive attachment element 194 along the length of the rotatable drive element thereby opening and/or closing the architectural covering 10.

In one arrangement, an aluminum material is desirable for use as the rotatable drive element 12 for the ease of which a knurling process can be performed. To improve the sliding of the driver attachment element 194 there over, a composite material is used for the interior surface 200 of drive attachment element 194 and tooth 202. To further improve the sliding of the driver attachment element 194 over the knurled surface of the rotatable drive element, a coating is imparted over the knurled surface of rotatable drive element 12 such as a Teflon material, anodizing or any other low friction coating.

Tooth Arrangement:

To also improve the sliding of the drive attachment element 194 over the knurled surface of the rotatable drive element 12 the interior surface 200 of rotatable drive element 12 has a lower density of teeth than the surface of rotatable drive element 12 has density of knurled threads. That is, as one example there is only one tooth 202 for every two knurled threads in the surface of the rotatable drive element 12. As another example, there is only one tooth 202 for every three knurled threads in the surface of the rotatable drive element 12. As another example, there is only one tooth 202 for every four knurled threads in the surface of the rotatable drive element 12. Other contemplated aspect ratios of teeth 202 to knurled threads include 1 for 5, 1 for 6, 1 for 7, 1 for 8, 1 for 9, 1 for 10, 1 for 11, 1 for 12, 1 for 15, 1 for 20, 1 for 25, 1 for 50, 1 for 75, 1 for 100 and the like. The reduction in the number of teeth 202 reduces the friction between the drive attachment element 194 and the rotatable drive element 12 which causes smoother operation and less consumption of energy.

First Alternative Arrangement:

With reference to FIGS. 14-25 an alternative arrangement is presented, which also includes all the above-identified elements, advantages and improvements and applies them to the alternative arrangement. As shown in these figures, a dual shade arrangement is presented with an exterior architectural covering 10E and an interior architectural covering 10I. This dual shade arrangement includes an exterior bracket 16E and interior bracket 16I. The exterior bracket 16E extends outwardly from the wall or structure it is connected to a distance further than the interior bracket 16I.

A separate motor housing 18 is connected to the interior bracket 16I and the exterior bracket 16E. A rotatable drive element 12 is connected to the inward end of the motor housings 18. Because these exterior and interior brackets 16E, 16I are of different lengths, the motor housings 18 and rotatable drive elements 12 are positioned in parallel spaced relation to one another. This parallel spaced relation allows for hanging two drapes or shade materials 192. Often, a shear shade material 192 is hung from the interior architectural covering 10I and a blackout shade material 192 is hung from the exterior architectural covering 10E. The interior bracket 16I is positioned in vertical alignment with and just inward of the exterior bracket 16E. In this way, the interior architectural covering 16I is slightly shorter than the exterior architectural covering 16E.

In the arrangement shown, the exterior size, shape and design of motor housing 18 is similar if not identical to the exterior size, shape and design of the rotatable drive element 12. As is shown, when the rotatable drive element 18 is connected to the motor housing 18 only a barely visible seam line exists between the two components. This provides a sleek and attractive aesthetic appearance.

A cap 204 is positioned in the open exterior end of the motor housing 18 connected to the interior bracket 16I. Cap 204 closes the open exterior end of motor housing 18 and thereby provides an improved aesthetic appearance while simultaneously protecting the components positioned within motor housing 18 from dust and other environmental effects. Cap 204 closes the motor housing 18 without substantially extending the length of the motor housing 18. Cap 204 connects to motor housing 18 by any means. In one arrangement, as is shown, cap 204 is sized and shaped to fit within and frictionally engage the hollow open end of motor housing 18. Alternatively, cap 204 is threaded as is the hollow open end of motor housing 18 and the two components threadably engage one another. Alternatively, cap 204 engages motor housing 18 by any other manner or means.

A rotatable drive element extension 182 is connected to the exterior end of the motor housing 18 connected to the exterior bracket 16E. Rotatable drive element extension 182 extends outwardly from the exterior end of motor housing 18. In the arrangement shown, the exterior size, shape and design of rotatable drive element extension 182 is similar if not identical to the exterior size, shape and design of the rotatable drive element 12 and the motor housing. As is shown, when the rotatable drive element extension 182 is connected to the motor housing 18 only a barely visible seam line exists between the two components. This provides a sleek and attractive aesthetic appearance. A cap 204 or a decorative finial 206 is connected to the exterior end of the rotatable drive element extension 182.

Exterior brackets 16E and interior brackets 16I have a bracket housing 208 which extend between a forward end 210 and a rearward end 212 and define an open interior 214. Bracket housing 208 has a generally flat or planar upper and lower faces which are connected to one another by generally rounded or arcuate sides.

The rearward end 212 of the bracket housing 208 flares out to a mounting flange 216. One, a pair of, or more alignment openings 218 are positioned within or adjacent to the mounting flange 216. One, a pair of, or more locking screw openings 220 which receive locking screws 222 are positioned within or adjacent to the mounting flange 216. In the arrangement shown, the alignment openings 218 are positioned in the upper edge of mounting flange 216 and the locking screw openings 220 are positioned in the lower edge of mounting flange 216.

Mounting plate 224 is sized and shaped to be received within and held by mounting flange 216 of brackets 16E, 16I. Mounting plate 224 has a generally flat or planar body 226 with a plurality of mounting holes 228 and a plurality of mounting slots 230 positioned therein. A mounting lip 232 extends around the periphery of body 226 and angles forward therefrom. One, a pair of or more alignment prongs 234 are positioned in the exterior periphery of the mounting lip 232 in corresponding positions to the alignment openings 218 in the bracket housing 208. The alignment prongs 234 extend upwardly a distance past the upward most edge of the mounting lip 232.

When installed and assembled, the mounting plate 244 is screwed or bolted in the desired position to a wall or other supporting structure with the alignment prongs 234 facing upward. Next, the mounting flange 216 of bracket 16 is positioned around the mounting plate 224. The forward end 210 of bracket 16 is angled slightly upward and the alignment openings 218 are aligned with the alignment prongs 234 of the mounting plate 224. In this position, the alignment prongs 234 are received within the alignment openings 218, thereby provisionally holding bracket 16 in place on mounting plate 224. Once in place, locking screws 222 are tightened within locking screw openings 220. This causes the upper or leading edge of the locking screws 222 to engage the exterior surface of mounting lip 232. Due to the angle of the mounting lip 232, when locking screws 22 engage the mounting lip 232 this forces bracket 16 rearward and pulls mounting plate 224 forward hereby forming an increasingly tight locking engagement therebetween.

The upper surface of bracket housing 208 includes an access panel 236 of any suitable size, shape and design. Access panel 236 is removable and replaceable and lockingly engages the bracket housing 208. Access panel 236 provides access to the open interior 214 of bracket 16 and facilities insertion and removal of batteries 140 therein.

A mounting member 238 is positioned in the forward end 210 of bracket housing 208. Mounting member 238 is formed of any suitable size, shape and design. In the arrangement shown, mounting member 238 includes a pair of L-shaped bracket rails 240 that extend outwardly from the forward edge end 210 of bracket housing 208. These L-shaped bracket rails 240 are positioned in parallel spaced alignment to one another with the flange of the L-shaped portion facing away from one another. Said another way, a groove exists between the forward end 210 of the bracket housing 208 and the flange of the L-shaped portion of each bracket rail 240. This groove facilitates mounting of the motor housing 18 to the bracket 16.

Bracket rails 240 are positioned in parallel spaced relation to one another with an opening therebetween that provides access to the open interior 214 of the bracket housing 208. Bracket electrical contacts 242 are positioned within the space between bracket rails 240. Bracket electrical contacts 242 are any form of a conductive device or object and serve to transmit electrical current from the bracket 16 to the motor housing 18. In the arrangement shown, a pair of bracket electrical contacts 242 are positioned within the space between bracket rails 240, one positive and one negative, and take the form of a panel of conductive material, such as copper, aluminum or the like and are separated by a non-conductor divider 244.

A battery cradle 246 is positioned within the open interior 214 of bracket housing 208. Battery cradle 246 is formed of any suitable size, shape and design and has an open interior which serves to hold and secure batteries 140 therein and transmit their electrical current to motor housing 18. In one arrangement, as is shown, battery cradle 246 has a rearward plate 248 which defines the rearward boundary for batteries 140 positioned within battery cradle 246, and a forward plate 250 which defines the forward boundary for batteries 140 positioned within of cradle 246. Also shown, is an optional center plate 252. Exterior bracket 16E is long enough from forward end 210 to rearward end 212 to house a single set of batteries 140 or two sets of batteries 140. When only a single set of batteries 140 is needed, the center plate 252 is used to limit the number of batteries that are needed to complete the circuit within battery cradle 246. When two sets of batteries 140 are desired, the center plate 252 is removed and two sets of batteries are required to complete the circuit. Alternatively, the center plate 252 is also used in a dual battery set arrangement, with a set of batteries 140 positioned on both sides of the center plate 252. To facilitate secure holding of batteries 140, the bottom surface of battery cradle 246 is arcuately contoured to receive individual batteries 140. In this way, proper alignment of batteries 140 is ensured. While not shown, battery cradle 246 also includes the necessary conductive leads or wires to transmit current, as well as springs to ensure electrical contact is achieved with batteries 140.

Socket 254 extends outwardly from the forward end or forward plate 250 of battery cradle 246. Socket 254 is formed of any suitable size, shape and design and serves to house bracket electrical contacts 242. In the arrangement shown, socket 254 has an exterior wall which extends around bracket electrical contacts 242 and along with divider 244 and provides support there to. Socket 254 is sized and within the opening between bracket rails 240 such that bracket electrical contacts 242 extend out of bracket housing 208 and are easily accessible between bracket rails 240.

Bracket coupler 256 is connected to and extends outwardly from the rear side of motor housings 18. Bracket coupler 256 is formed of any suitable size, shape and design and serves to connect motor housing 18 to bracket 16. In the arrangement shown, bracket coupler 256 is sized and shaped to receive the mounting member 238 of the brackets 16. Bracket coupler 256 includes a backing plate 258 which arcuately curves and receives the exterior profile of motor housing 18. An upper rail 260 and a lower rail 262 are positioned in parallel spaced relation to one another and extend outwardly from the backing plate 258 and are sized, shaped and spaced to frictionally engage and lockingly receive the mounting member 238 of brackets 16. In the arrangement shown, upper and lower rails 260, 262 are formed of a similar L-shaped design as are the bracket rails 240 of mounting member 238, with one difference being the L-shaped upper and lower rails 260, 262 with the flange of the L-shaped portion facing towards one another.

Another feature of the bracket coupler 256 is that the upper rail 260 has a longer length than the lower rail 262, and the lower rail 262 is approximately centrally positioned below the upper rail 260. This provides an upper rail 260 with a portion of overhang on the inward and outward sides that does not have the lower rail 262 positioned below it. This allows a user, during installation, to set this overhanging portion of upper rail 260 on top of the mounting member 238 of brackets 16 prior to fully engaging the bracket coupler 256 over the mounting member 238. This provides a manner and method of provisionally supporting and aligning the motor housing 18 during installation. Also, to aid in installation and alignment, the inward and outward leading edges of the flange of the L-shaped portion of the lower rail 262 have a chamfered portion 264.

A contact opening 266 is positioned in the rearward side of motor housing 18 between the upper rail 260 and lower rail 262. Contact opening 266 provides for egress for motor electrical contacts 268 which are connected to and extend rearward from PC board 116 and through contact opening 266. Motor electrical contacts 268 are formed of any suitable size, shape and design and serve to transmit power from bracket electrical contacts 242 to PC board 116 and ultimately motor 76. In the arrangement shown, motor electrical contacts 268 are formed of a conductive piece of material in a triangular shape with a rounded nose. This triangular shape with a rounded nose allows for installation of the motor housing 18 on brackets 16 from either lateral side.

Motor electrical contacts 268 also protrude through openings in contact plate 270. Contact plate 270 is formed of any suitable size, shape and design. In the arrangement shown, contact plate 270 is frictionally engaged and held within contact opening 266. Contact plate 270 includes a plurality of snap-fit-features 272, which in the arrangement shown are flexible arms, which engage the sides of contact opening 266 and fixedly hold thereon thereby securing Contact plate 270 to motor housing 18. Contact plate 270 also includes board support members 274 which engage and provide support for PC board 116 adjacent contact opening 266. In the arrangement shown, board support members 274 include a pair of ribs or ridges positioned in parallel spaced relation and sized and shaped to receive the rearward edge of PC board 116 therebetween thereby providing strength, rigidity and support to PC board 116.

Figure 23:
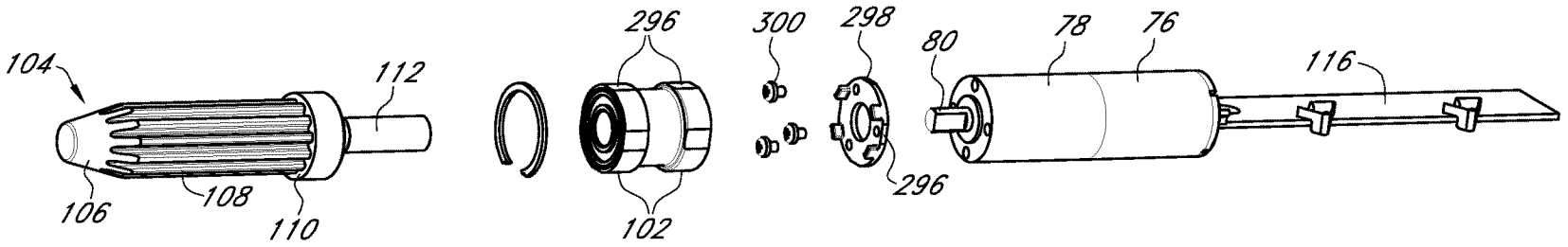
FIG. 23 is a close up exploded perspective view of the motor, transmission, PC board, bearings and motor coupler, the view showing the alignment plate and the alignment features.
Figure 24:
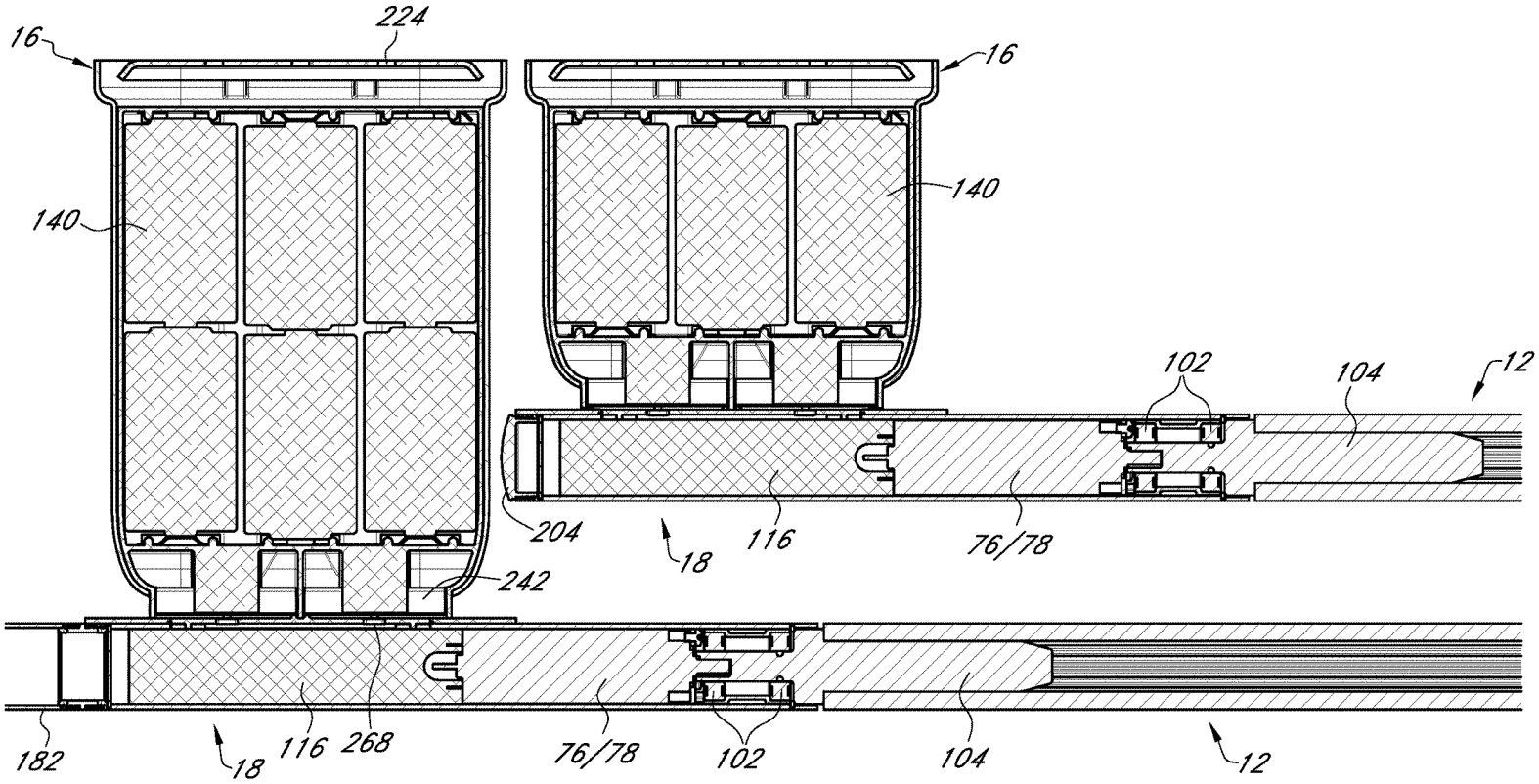
FIG. 24 is a top cut-away sectional view of the view of FIG. 14, the view showing the internal components of the assembly.

Contact plate 270 also includes a stop member 276. Stop member 276 is positioned between the opposing motor electrical contacts 268 and serves as a stop for insertion of the motor housing 18 on bracket 16. In one arrangement, when fully installed, stop member 276 engages or stops at center divider 244 of socket 254. That is, when motor housing 18 is installed on bracket 16 from either lateral side, the leading motor electrical contacts 268 will bend or deflect to get past the center divider 244, however the stop member 276 will not and therefore the motor housing 18 is fully installed on bracket 16 when stop member 276 engages center divider 244. In an alternative arrangement, as is shown in FIG. 23, stop member 276 has a pair of vertical ribs 278 with a slight recess positioned therebetween. In this arrangement, motor housing 18 is slid over bracket 16 until center divider 244 is received within the recess. While the motor electrical contacts 268 easily deflect to get past the center divider 244, additional force is required to deflect the contact plate 270 such that the center divider can pass the first of the vertical ribs 278. Once past the first vertical rib 278 the center divider 244 is tightly and frictionally received in the recess between the first and second vertical ribs 278. These forces are easily felt by the installer and provide feedback in the form of resistance thereby assuring the user when the motor housing 18 is fully installed on the bracket 16.

Figure 14:
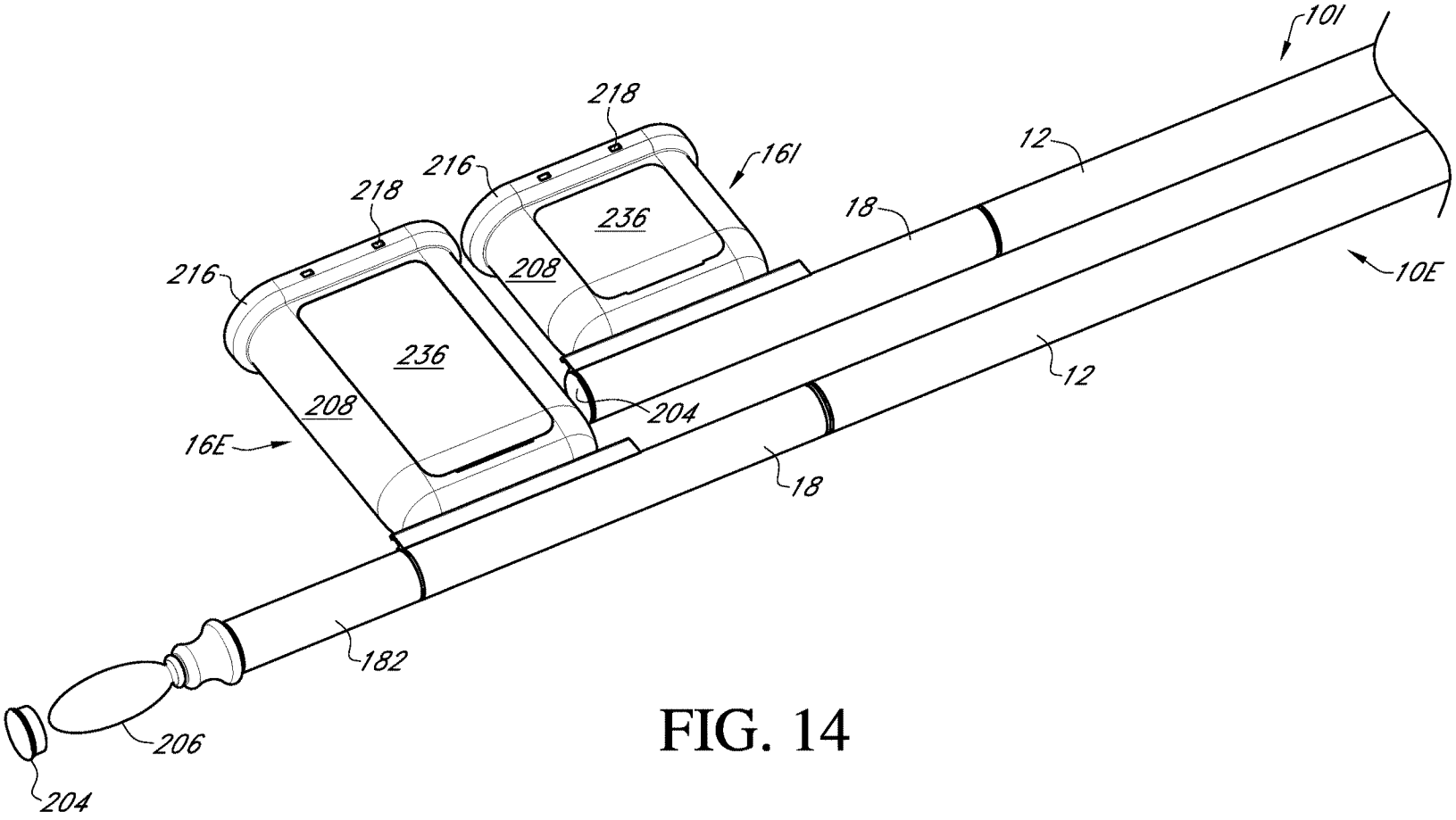
FIG. 14 is a perspective view of a first alternative embodiment of the system showing mounting brackets which house a plurality of batteries, the view showing a longer exterior bracket and a shorter interior bracket, the view showing the mounting brackets connected to a bracket coupler which is mounted on a motor housing, the view showing the exterior motor housing having a finial connected to its exterior end and the interior motor housing having a cap connected to its exterior end, the view showing rotatable drive elements connected to the interior end of the motor housings.
Figure 15:
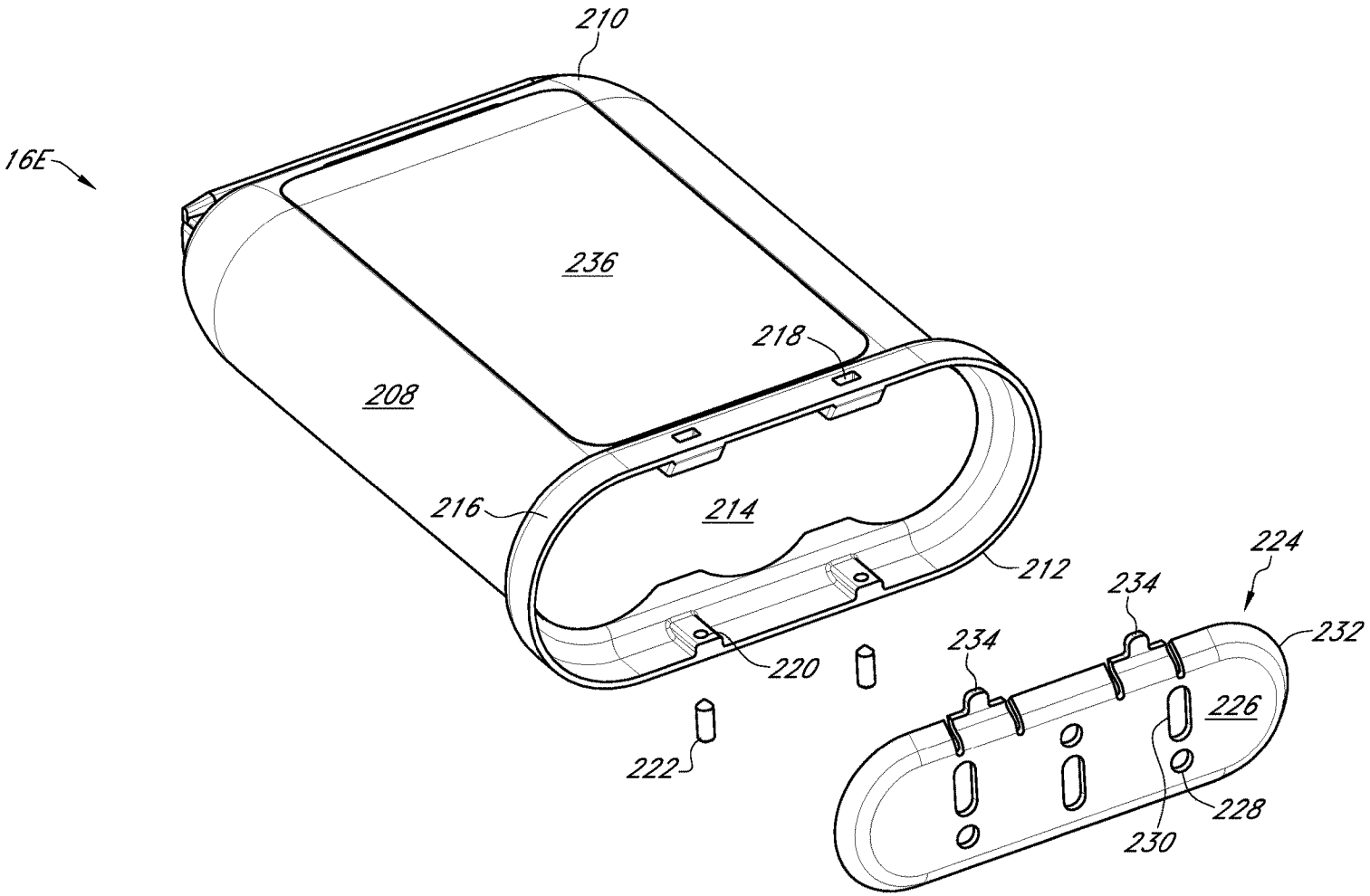
FIG. 15 is a perspective exploded view of the rear side of the exterior bracket shown in FIG. 14, the view showing the mounting plate and locking screws which connect to the bracket housing.
Figure 16:
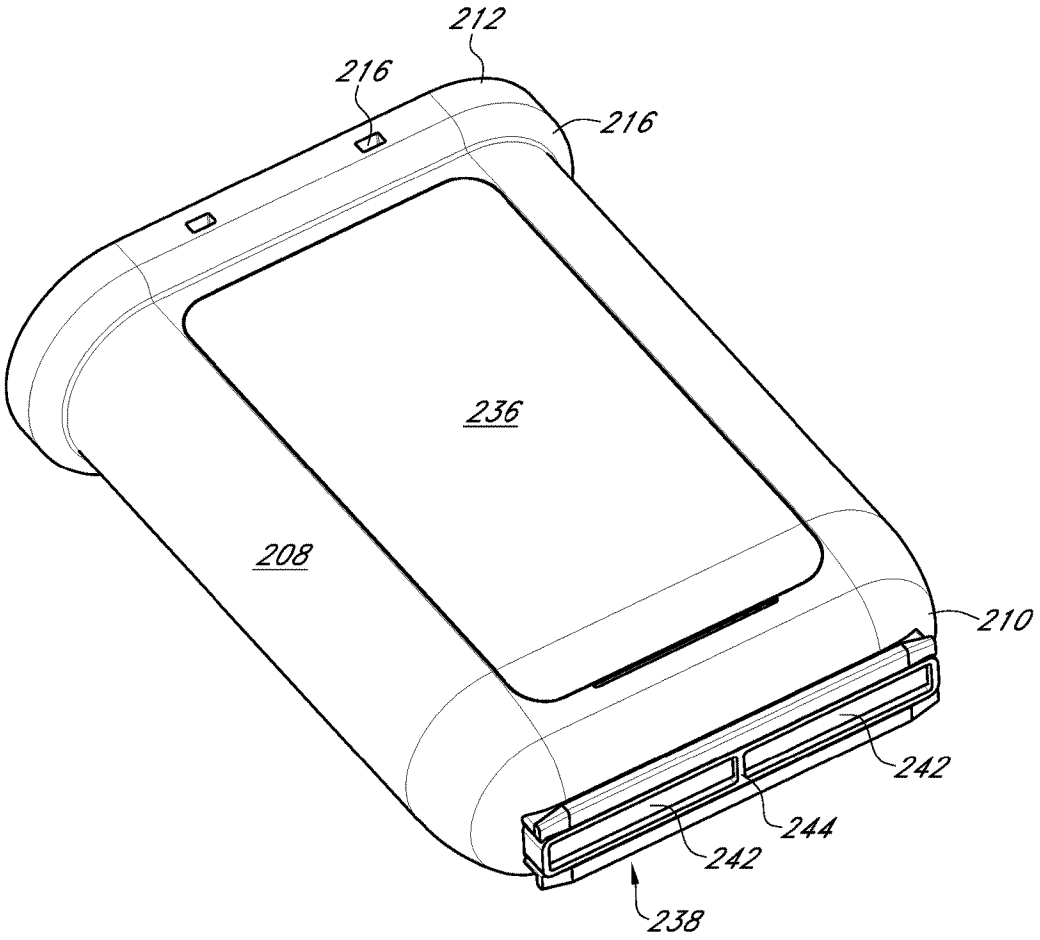
FIG. 16 is a perspective view of the front side of the exterior bracket shown in FIG. 14, the view showing the bracket electrical contacts positioned within the mounting member adjacent its front side, the view also showing the access panel which is used to install the batteries therein.
Figure 17:
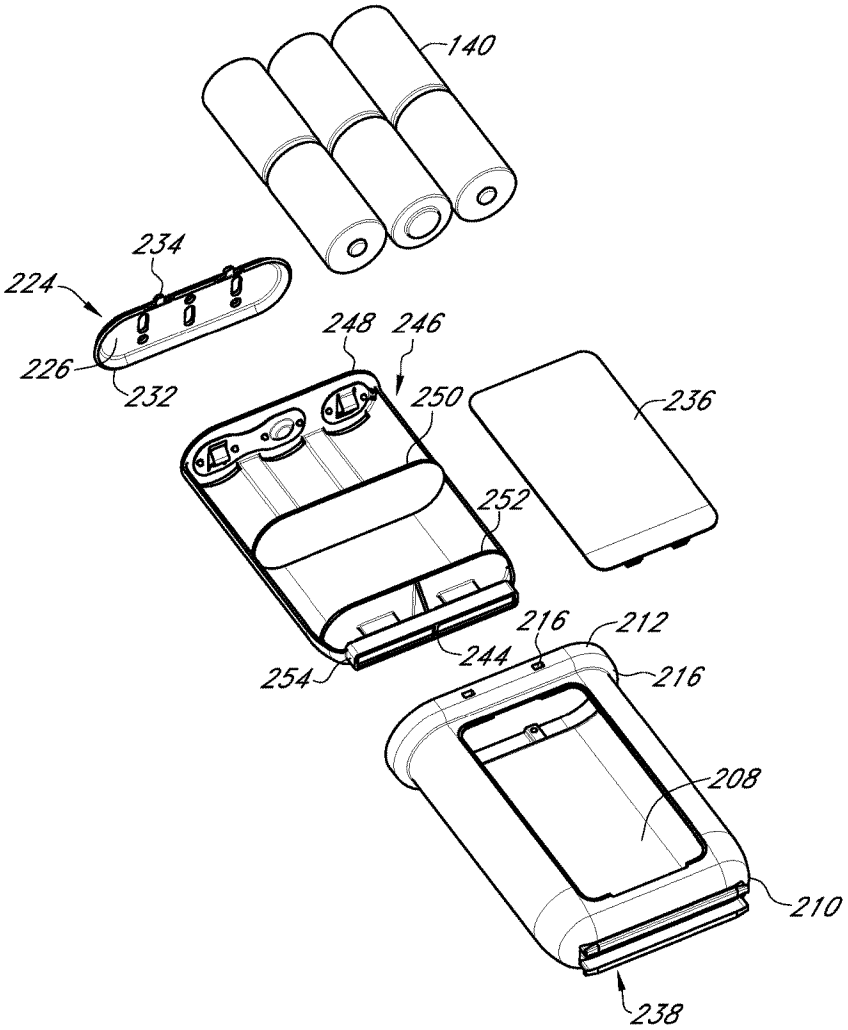
FIG. 17 is a perspective exploded view of the exterior bracket shown in FIG. 16, the view showing the bracket housing, the battery cradle, mounting plate, access panel and a plurality of batteries.
Figure 18:
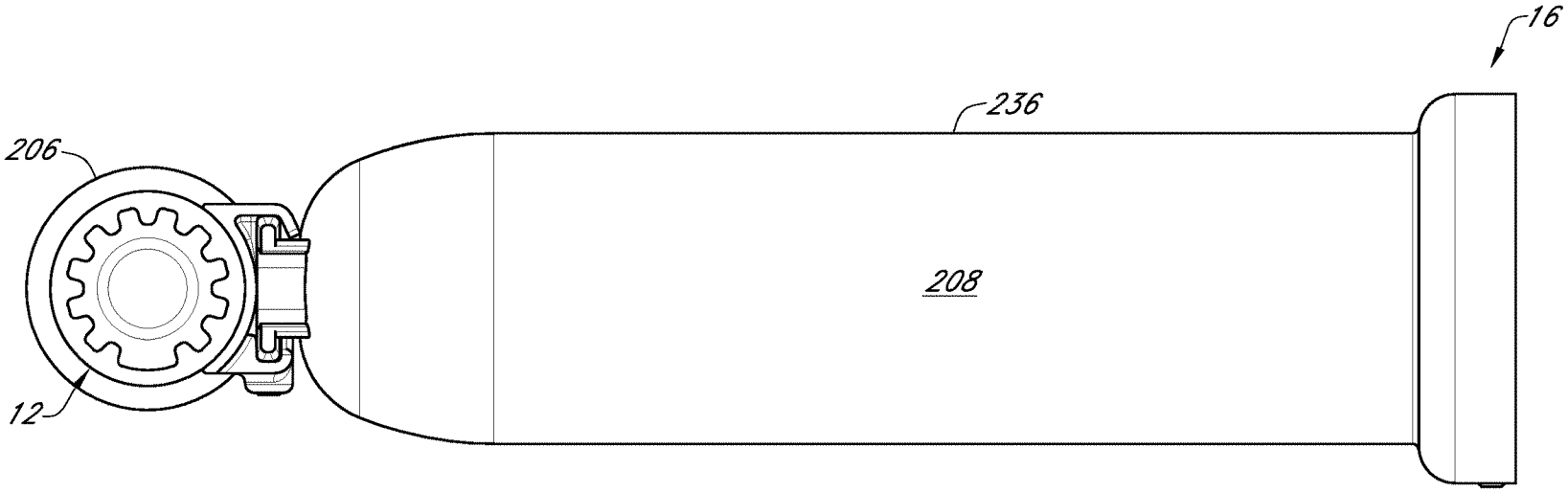
FIG. 18 is a side elevation view of the exterior bracket connected to a rotatable drive element, the view showing the mounting member of the bracket held within the bracket coupler of the motor housing, the view also showing the interior features of the rotatable drive element including the key feature as well as the plurality of teeth.
Figure 19:
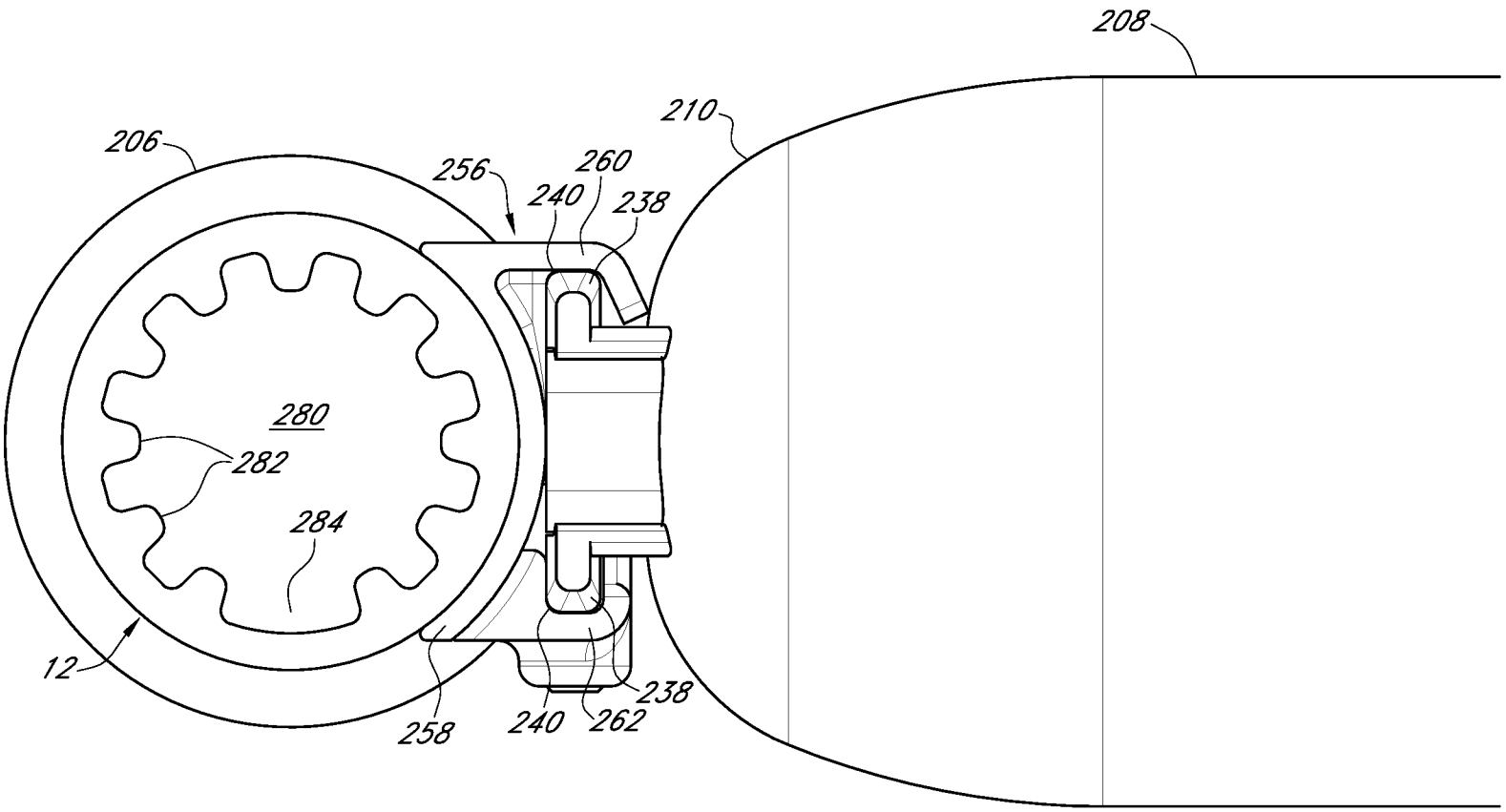
FIG. 19 is a close up side elevation view of FIG. 18.
Figure 20:
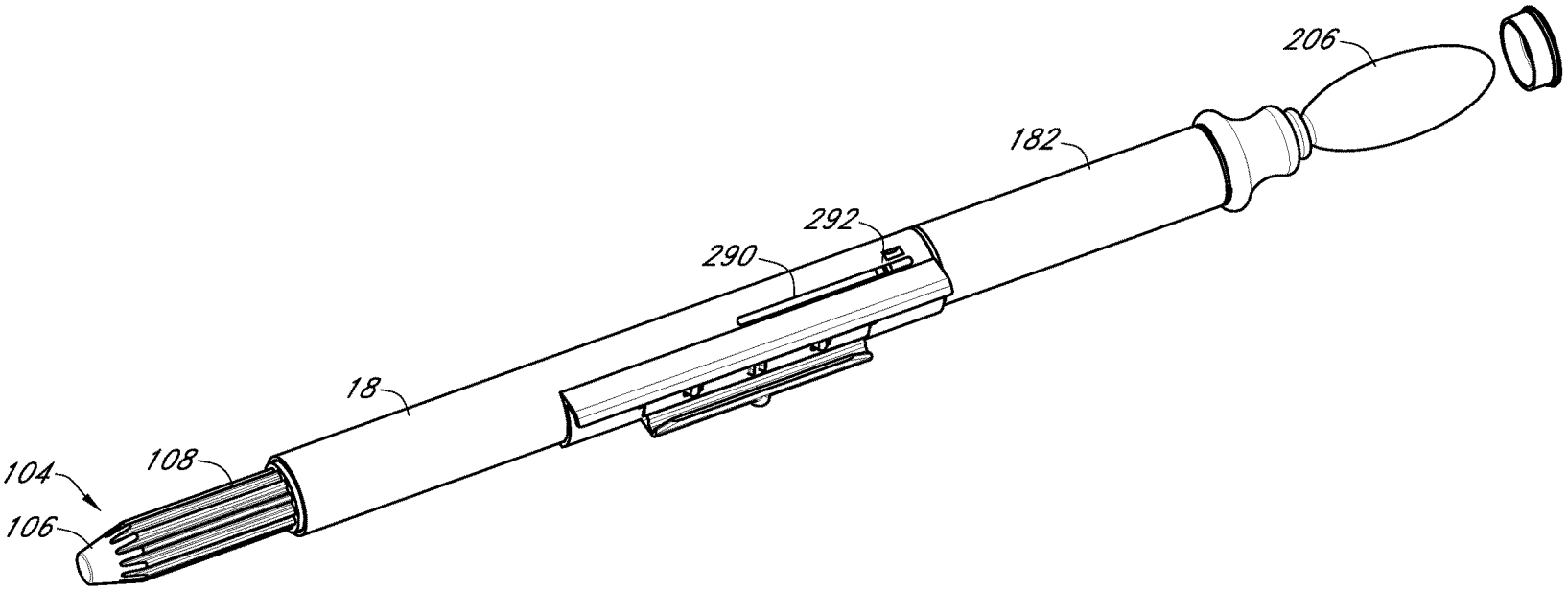
FIG. 20 is a perspective view of the back side of the motor housing showing the motor coupler, the view also showing the bracket coupler with the motor housing electrical contacts positioned therein, the view showing the rotatable drive element extension and the finial.
Figure 21:
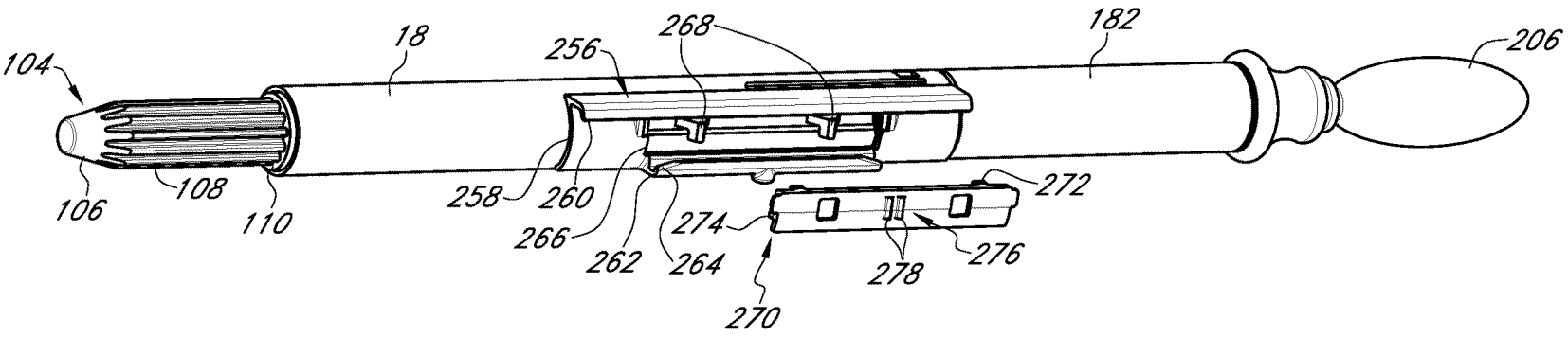
FIG. 21 is a close up exploded perspective view of FIG. 20 with the alignment plate removed from around the motor housing electrical contacts.
Figure 22:
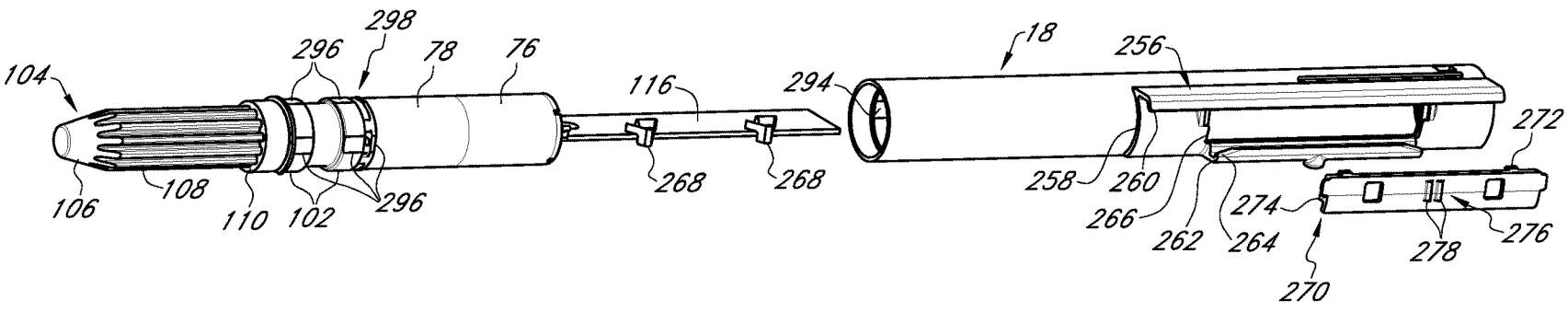
FIG. 22 is another a close up exploded perspective view of FIG. 20 with the motor, transmission, PC board, bearings and motor coupler removed, the view also showing the alignment plate removed as well and the alignment features.

Motor housing 18 is shown fully installed over bracket 16 in FIGS. 14, 18 and 19. In this arrangement, the inwardly facing L-shaped flanges of upper and lower rails 260, 262 are fully installed over and in engagement with the outwardly facing L-shaped flanges of mounting member 238. In this position, motor electrical contacts 268 extend between motor housing and bracket 16 and engage bracket electrical contacts 242 thereby completing the circuit.

Figure 25:
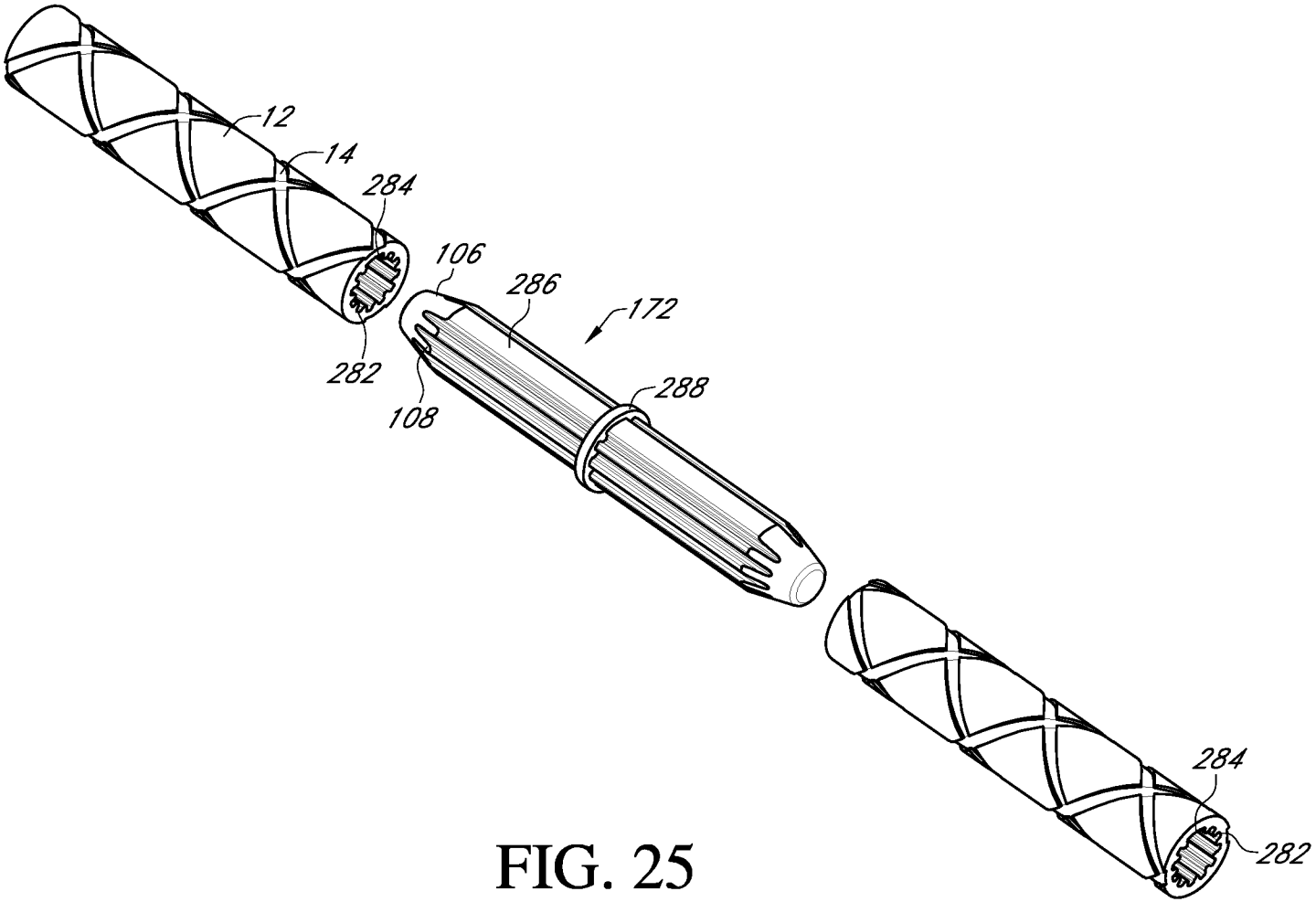
FIG. 25 is an exploded perspective view of two drive elements in an unassembled state along with a center coupler the view showing the key feature and key tooth arrangement aligned with the guide structure.
Figure 26:
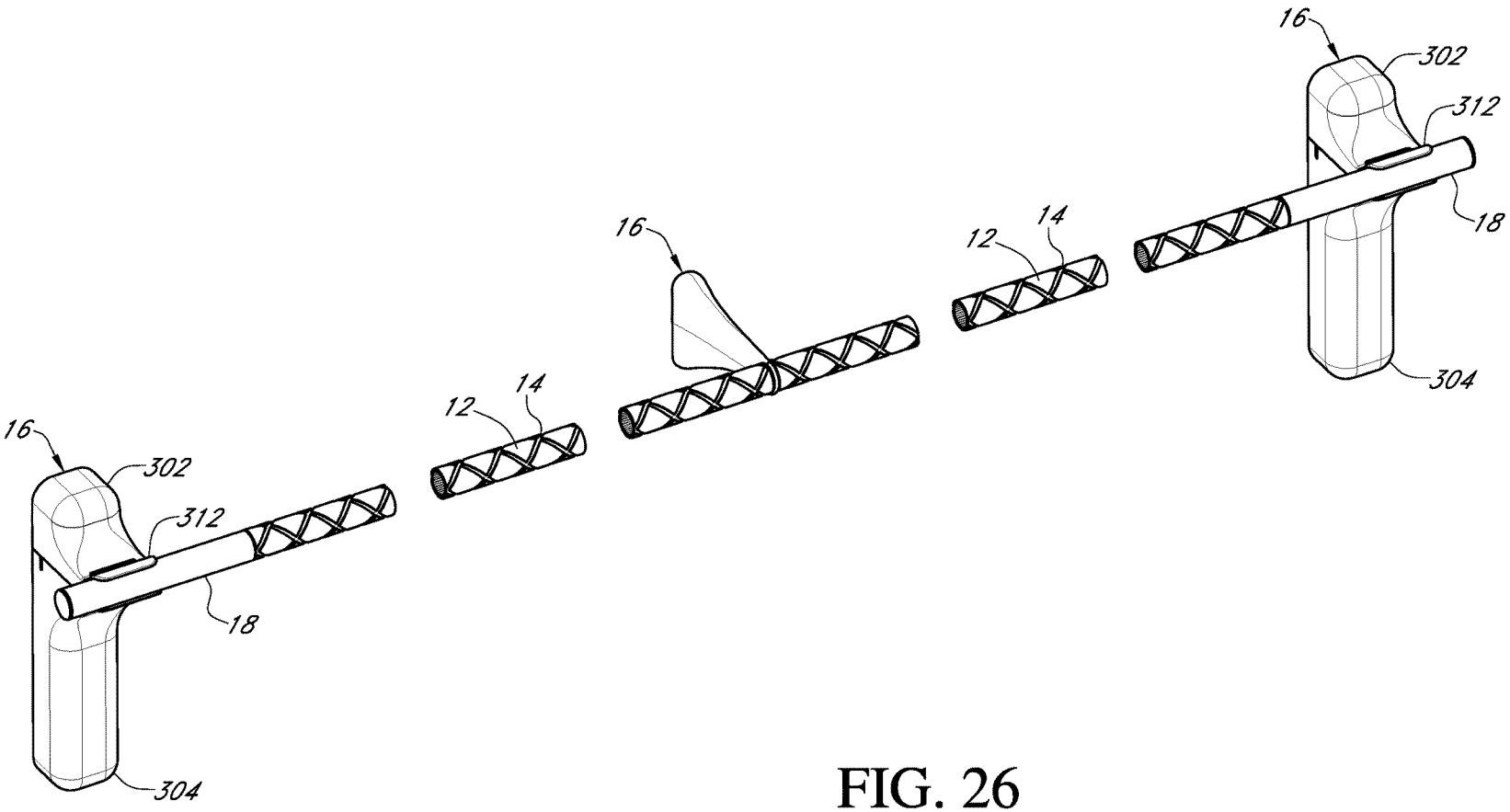
FIG. 26 is a perspective view of a second alternative embodiment of the system showing mounting brackets which house a plurality of batteries, the view showing a top cover and a bottom cover connected to the end brackets which house the motor controller assembly and the batteries, and a center support bracket which supports the pair of rotatable drive elements at their middle.
Figure 27:
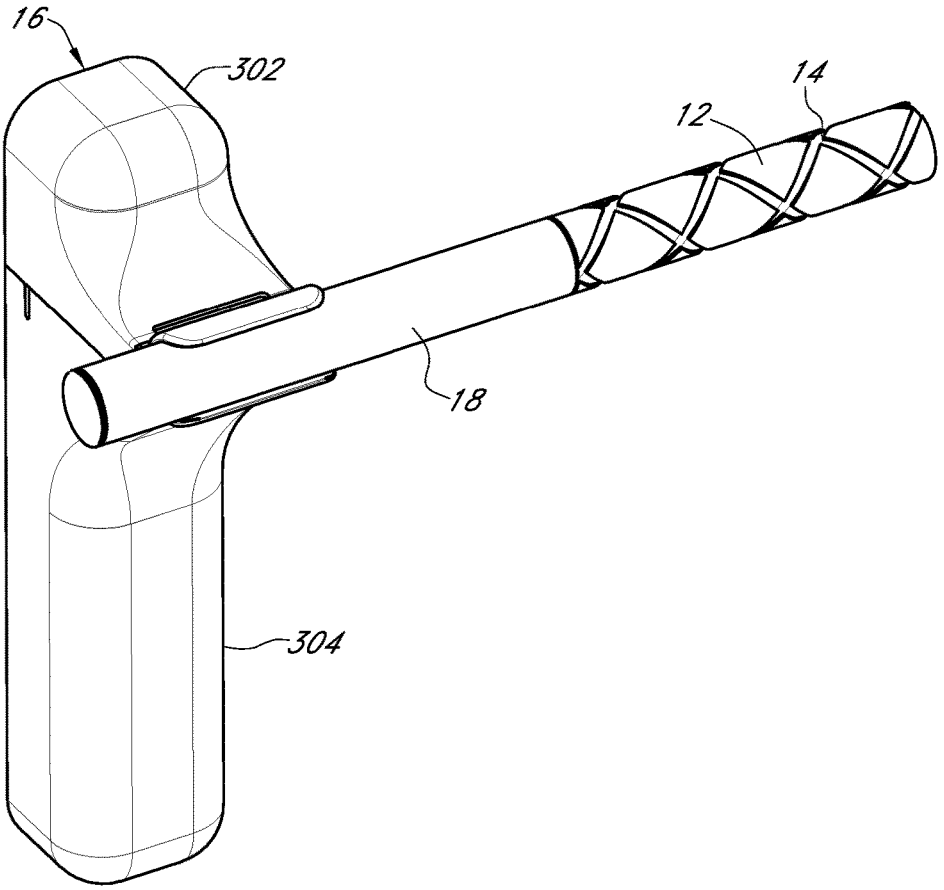
FIG. 27 is a close up perspective view of the end bracket of FIG. 26, the view showing the bracket, the motor housing, the rotatable drive element, the top cover and the bottom cover.
Figure 28:
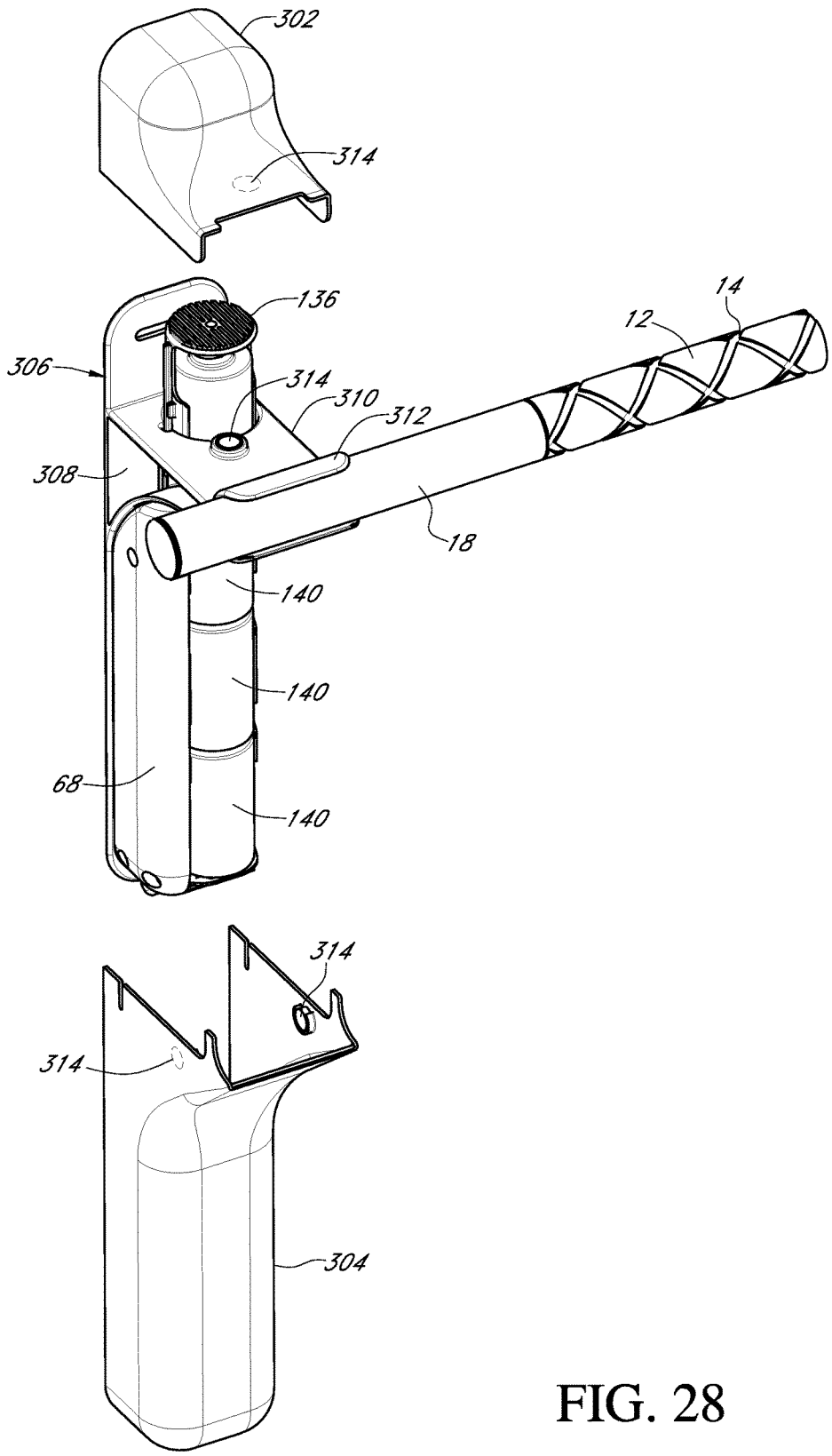
FIG. 28 is an exploded perspective view of the end bracket of FIG. 27, the view showing the bracket, the motor housing, the rotatable drive element, the top cover, the bottom cover the batteries, the motor controller assembly and the battery tube assembly.
Figure 29:
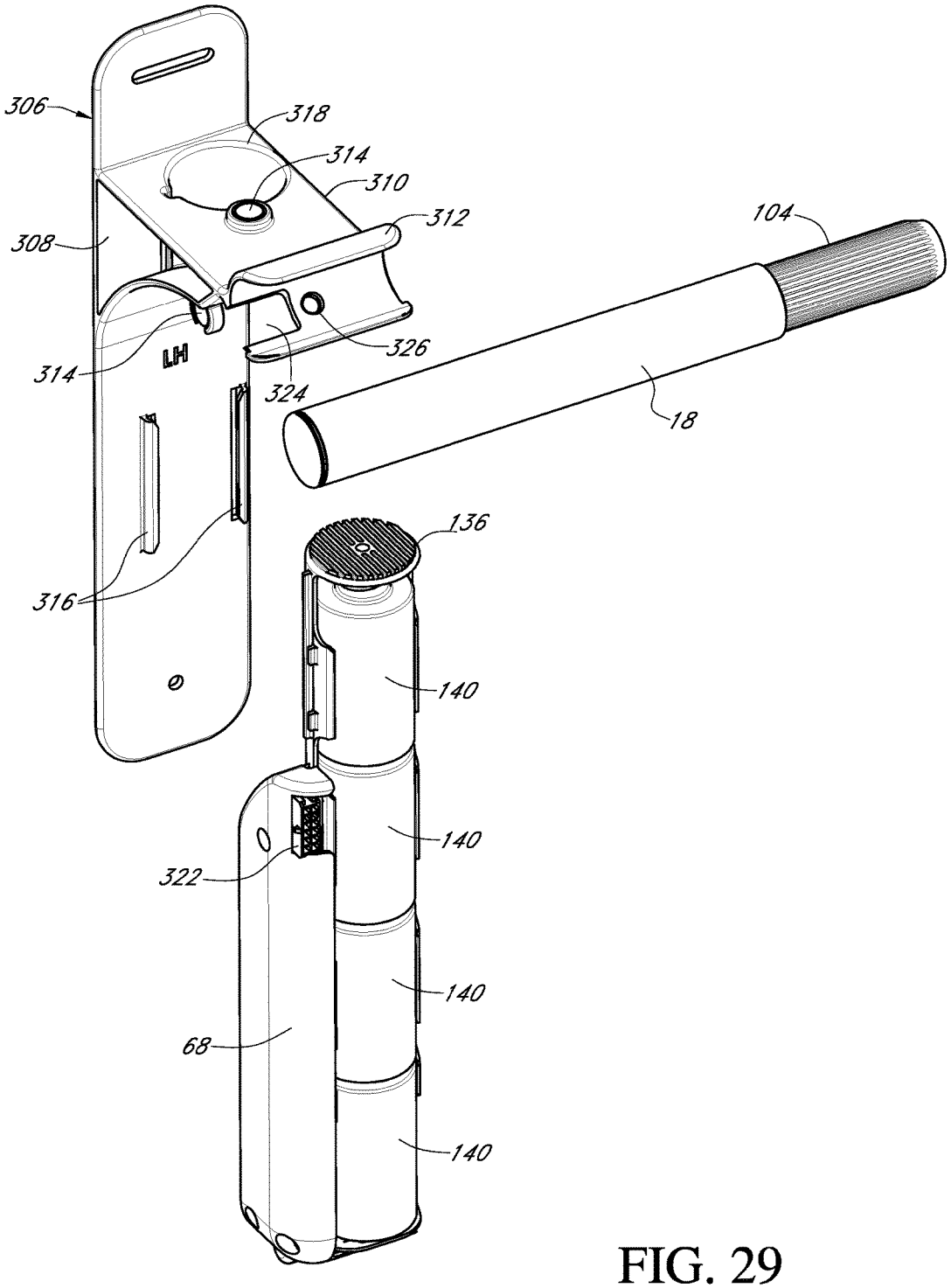
FIG. 29 is a further exploded perspective view of the end bracket of FIG. 28, the view showing battery tube assembly and the motor controller assembly removed from the bracket, as is the motor housing removed from the bracket.
Figure 30:
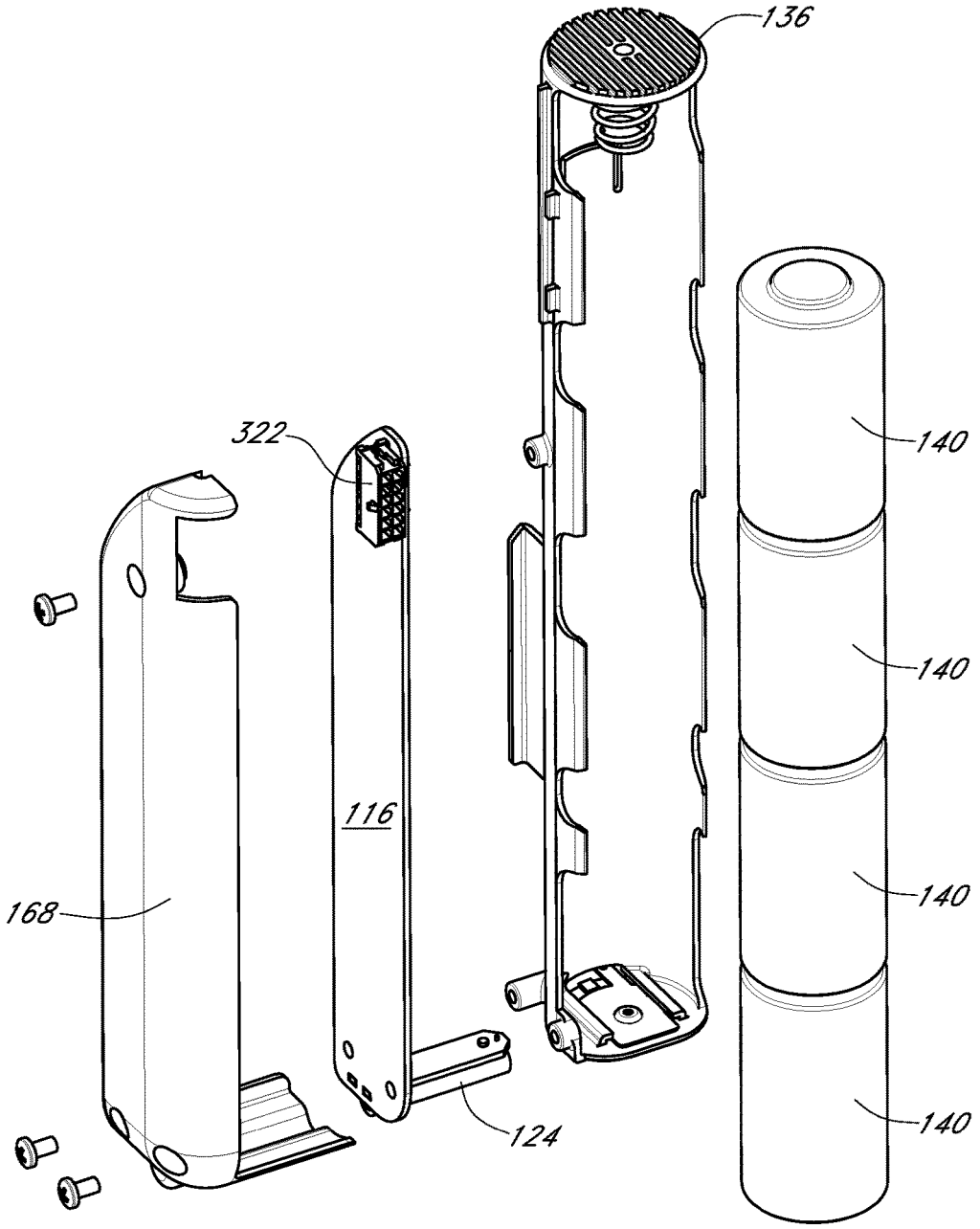
FIG. 30 is a further exploded perspective view of the motor controller assembly and the battery tube assembly of FIG. 29.
Figure 31:
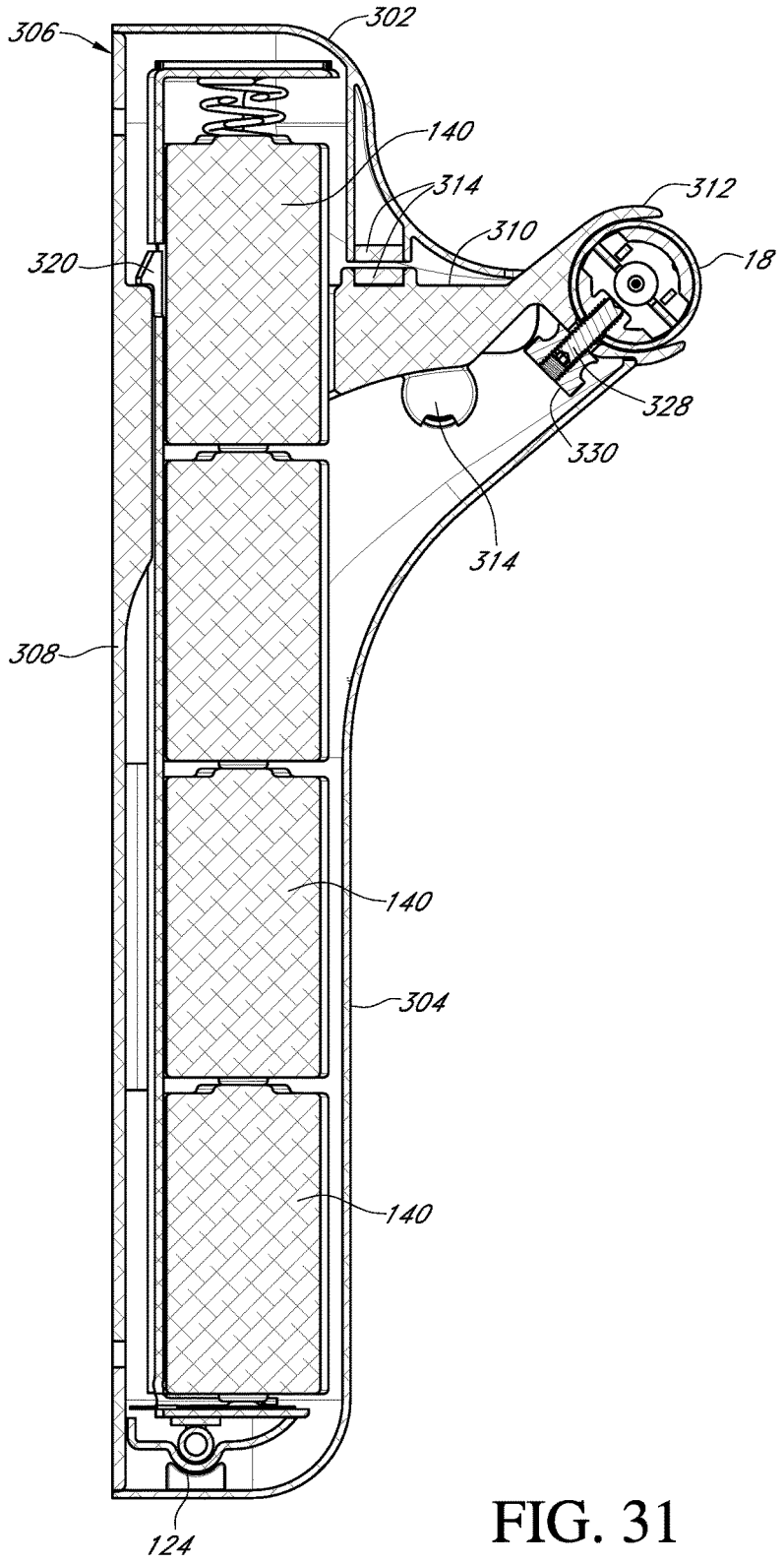
FIG. 31 is a side cut-away elevation view of an assembled bracket of the FIG. 26, the view showing the snap feature which holds the battery tube assembly and the motor controller assembly onto the bracket, the view also showing the mounting post and the thumb screw which hold the motor housing onto the socket of the bracket.
Figure 32:
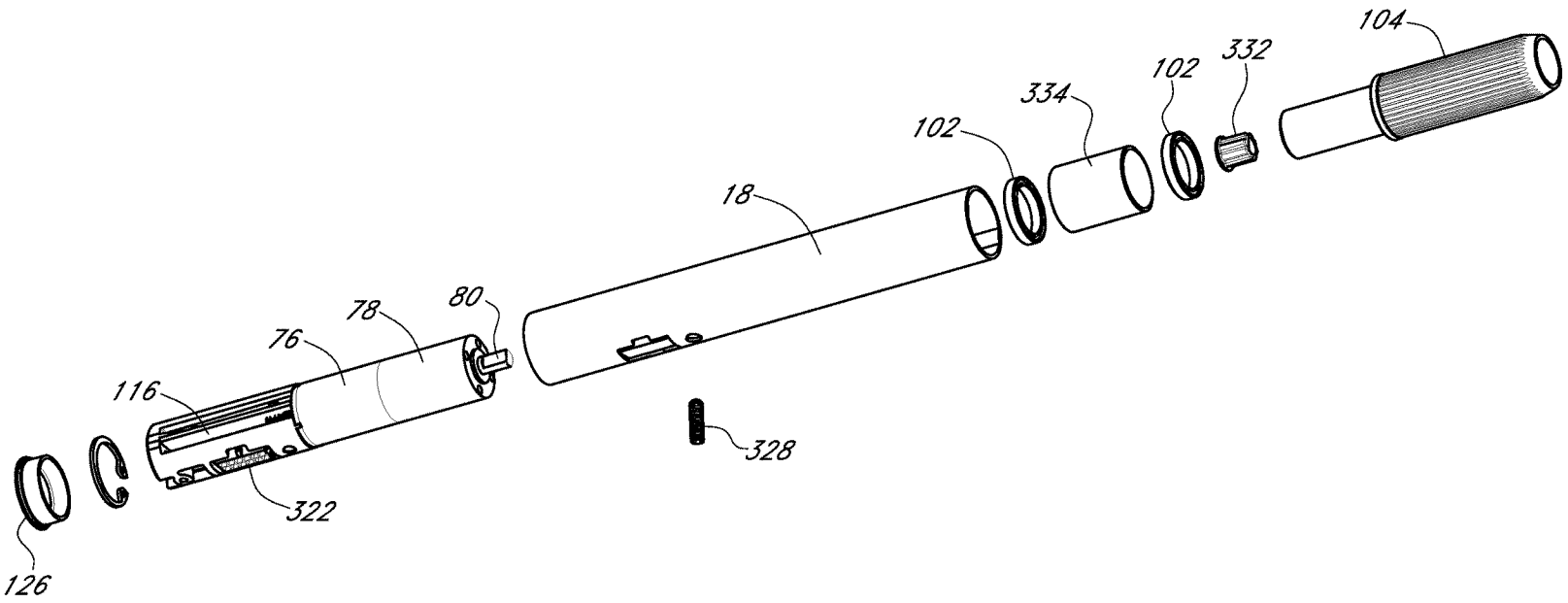
FIG. 32 is an exploded perspective view of the motor housing of FIG. 26 the view showing the electrical socket, the second PC board, the motor housing tube, bearings, spacers and motor coupler.
Figure 33:
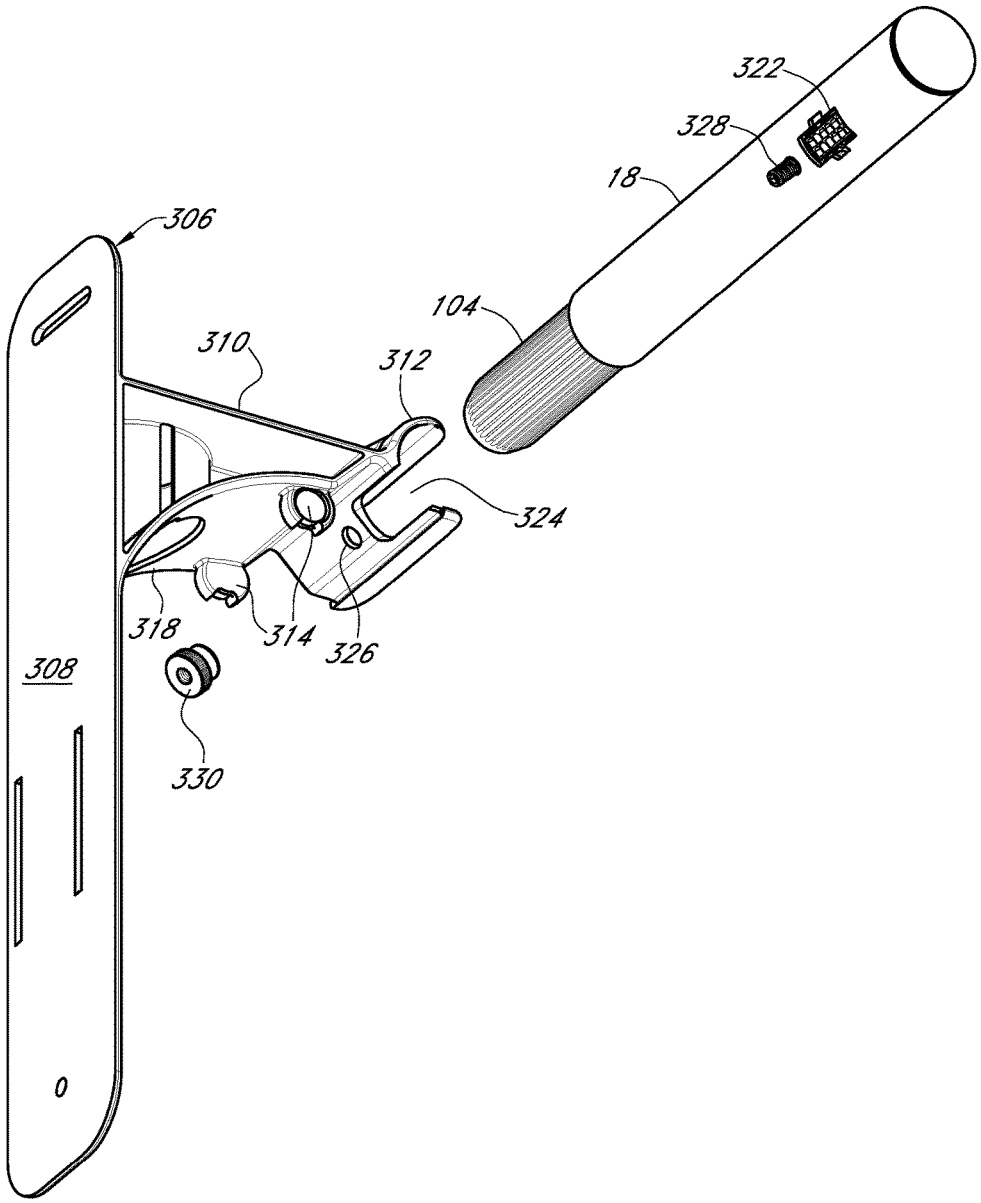
FIG. 33 is a rear exploded perspective view of the bracket and the motor housing in a pre-assembled state, the view showing the notching and the opening in the bracket to allow for installation of the motor housing onto the socket of the bracket.
Figure 34:
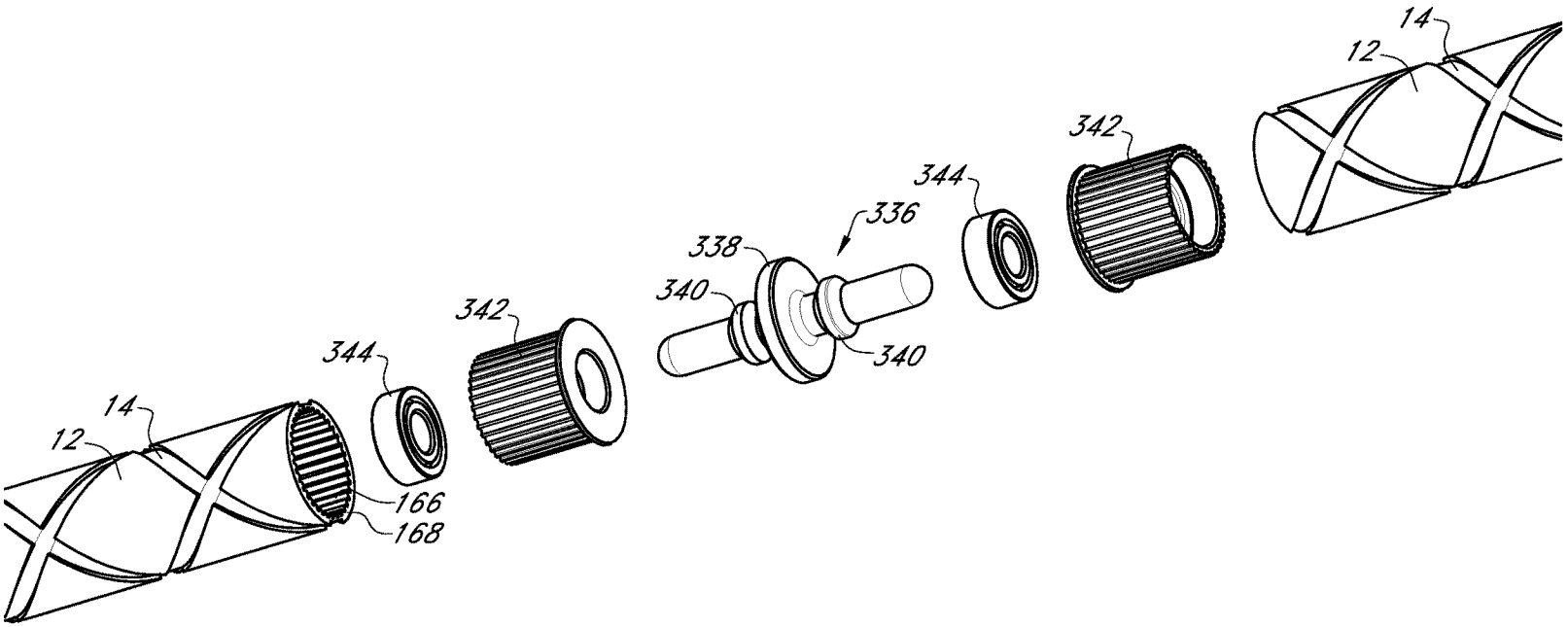
FIG. 34 is an exploded perspective view of a center support shaft with a circular collar positioned at its middle with a stop positioned on either side of the circular collar and a pair of bearings and bushings that allow for independent rotation of the rotatable drive elements.
Figure 35:
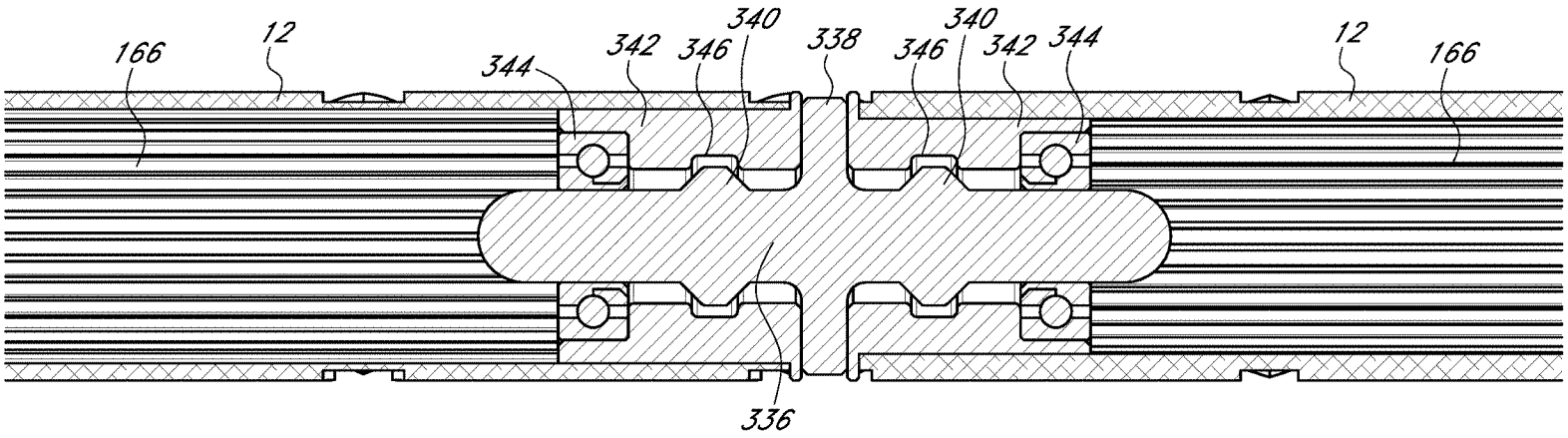
FIG. 35 is side cut-away elevation view of an assembled independent rotation center support shaft of FIG. 34.

Also, as is shown in FIG. 19, is the hollow interior 280 of rotatable drive element 12. Included within the hollow interior 280 of rotatable drive element 12 is a plurality of teeth 282 and a key feature 284. Teeth 282 are sized and shaped to receive gears 108 in the surface of motor coupler 104 and/or center coupler 172. A key tooth 286 is placed in the motor coupler 104 and/or the center coupler 172 which is sized and shaped to be received within the key feature 284. The guide structure 14 is indexed to the key feature 284 and key tooth 286. The use of the key feature 284 and key tooth 286 in the rotatable drive element 12 and the motor coupler 104 and/or the center coupler 172 allows for the guide structure 14 to be at a known relative position. With reference to FIG. 25, this allows for the alignment of two, or more, rotatable drive elements 12 at a center coupler 172 with the guide structure 14 aligned in a seamless and continuous manner, separated only a shoulder 288 in the center of center divider 172.

Slot Antenna:

The motor housing 18 also includes a slot antenna 290. A slot antenna 290 is formed of a slot in the surface of the motor housing 18 (which is typically formed of a metallic material) with a receptor 292 extending across the slot or in close proximity to the slot. Slot antennas are known in the art. The slot radiates electromagnetic waves in a similar manner to a dipole antenna which is received by the receptor 292. A slot antenna provides the advantage of being simple, have radiation patterns that are relatively omnidirectional (similar to a linear wire antenna) and can be easily mounted to many surfaces, including the motor housing 18. In addition, the slot antenna is very subtle and barely visible and the polarization of the slot antenna is linear. In addition, the slot size, shape and what is behind it (the cavity) offer design variables that can be used to tune performance.

Alignment Features:

In the arrangement shown, motor housing 18 is stationary while rotatable drive element 12 rotates. To facilitate this arrangement, motor 76 and transmission 78 are stationary, while motor coupler 104 is rotated when motor 76 is energized. The motor 76, transmission 78, bearings 102, motor coupler 104, PC board 116 and related elements are generally referred to as the motor assembly. The external surfaces of the motor assembly (motor 76, transmission 78 and bearings 102) are generally cylindrical in shape, as is the hollow interior of motor housing 18, the motor 76, transmission 78 and bearings 102 have a tendency to rotate when motor 76 is energized. To combat this tendency at least one alignment feature 294 is positioned in the interior surface of motor housing 18 adjacent where the motor 76, transmission 78 and bearings 102 are installed. In the arrangement shown, a plurality of alignment features 294 are positioned in the interior surface of motor housing 18 to break up the generally cylindrical interior surface. In the arrangement shown, a simple flat portion or rib or plane is use, however any other form of an alignment feature is hereby contemplated such as a groove, a protrusion, or the like.

A corresponding alignment feature 296 is positioned in the exterior surface of motor 76, transmission 78 and/or bearings 102. When motor 76, transmission 78 and bearings 102 are installed the alignment features 294, 296 engage one another. When torque is generated by powering motor 76, engagement of alignment features 294, 296 prevent rotation of motor 76, transmission 78 and bearings 102 within motor housing 18.

In one arrangement, an alignment plate 298 having alignment features 296 therein is connected to the motor 76 by any conventional means. In the arrangement shown, alignment plate is screwed or bolted to the forward edge of motor 76 around drive shaft 80 using fasteners 300. Alignment plate 298 converts the generally cylindrical exterior shape of motor 76 and transmission 78 to non-round and thereby prevents rotation of motor 76 and transmission 78 within motor housing 18.

Guide Structure:

In the arrangement shown in FIG. 25 a rectangular or squared groove is presented as guide structure 14. That is, when viewed from the side, guide structure 14 is a generally square or rectangular groove. Testing has proven that square or rectangular grooves as guide structure 14 provide promising performance. That is, the square or rectangular groove provides improved guidance to tooth 202 of drive attachment element 194 and reduces the number of failures. In this arrangement, Teeth 202 have a size and shape that closely match the dimensions of the square or rectangular groove of guide structure 14. In an alternative arrangement, any other shaped groove is used as guide structure 14 as a rounded groove or the like.

In this arrangement, four leads or four grooves are presented as guide structure 14. These leads are broken into two pairs, a first pair having a right hand twist, and a second pair having a left hand twist. The two grooves of both the first pair and the second pair are positioned opposite to one another on drive element 12, or said another way, the two grooves are diametrically opposed one another. The two pairs, the left hand twist pair and the right hand twist pair are equally spaced to one another. As is shown, the two pairs of grooves cross one another perpendicularly or at a 90 degree angle. As is shown, the two pairs of grooves begin and/or end at the same position on rotatable drive element 12 and twist opposite one another. When the two pairs of grooves cross or intersect one another, both grooves cross one another at the same position, opposite one another on the rotatable drive element. This is accomplished by having a consistent angle of rotation throughout the length of the grooves, and maintaining the position of the grooves within close tolerances throughout the length of the rotatable drive element.

In Operation:

As one example, the architectural covering of FIGS. 15-31 is installed around a conventional window. In this arrangement the position of the brackets 16E, 16I are located by finding the center of the window and measuring outwardly there from the length of the rotatable drive elements 12. In the event that a center bracket 16 is used, the center bracket 16 is installed at the center of the window. In the event that a center coupler 172 is used, the center coupler 172 is inserted into the hollow interior of the inward ends of the opposing rotatable drive elements 12. Care is taken to ensure that the key tooth 286 of the center coupler 172 engages the key feature 284 of the rotatable drive elements 12. When the key tooth 286 of the center coupler 172 engages the key feature 284 of the rotatable drive elements 12 the guide structures 14 of the two rotatable drive elements 12 align with one another. This ensures that the position of drive attachment elements 194 on opposing rotatable drive elements 12 will match and meet one another and in this way ensures proper opening and closing of the shade material 192.

The exterior ends of the rotatable drive elements 12 are connected to the motor housing 18 by inserting the motor coupler 104 into the hollow interior of the rotatable drive element 12, again making sure that the key tooth 286 engages the key feature 284. In the event that the length of the rotatable drive element 12 must be modified, the user cuts excess length off of the outward end of the rotatable drive element 12. This allows the user to modify the length of the rotatable drive element 12 while not disturbing the alignment of the guide structure 14 between the two rotatable drive elements 12.

The mounting plate 224 is installed on the wall and the bracket 16I is installed over the mounting plate 224 ensuring that the alignment prongs 234 are engaged in the alignment openings 218 and the locking screws 222 are tightened. Batteries 140 are inserted into the open interior 214 of the bracket 16I and the access panel 236 is installed.

The motor housing 18 is installed over the forward end 210 of the bracket 16 by sliding the bracket coupler 256 laterally over the mounting member 238 of bracket 16I. Once installed the upper rail 260 and the lower rail 262 of the bracket coupler 256 surrounds and lockingly engages the mounting member 238. In this position, the motor electrical contacts 268 engage the bracket electrical contacts 242 and power is supplied from batteries 140 to the pc board 116. In this position, the divider 244 of bracket 16I is received within the valley between the vertical ribs 278 of the stop member 276.

This process is repeated for both sides of the rotatable drive element 12, and is again repeated for the exterior architectural covering 10E.

In this way, a wirelessly controllable, motorized, and battery powered drapery product is presented that allows independently control and operate two shades materials 192, which is often a sheer shade attached to the interior architectural covering 10I and a blackout shade connected to the exterior architectural covering 10E.

Second Alternative Arrangement:

With reference to FIGS. 26-36 a second alternative arrangement is presented. This arrangement, is similar to those presented herein, and incorporates the teachings of those arrangements, with the following specified differences.

The system includes a pair of rotatable drive elements 12 having helical guide structures 14 connected by a center coupler 172 at their inward ends. Center coupler is rotatably connected to a center bracket 16. The outward ends of rotatable drive elements 12 are rotatably connected to motor assembly 18, whereas motor assembly 18 is non-rotatably connected to bracket 16. Brackets 16 include have a top cover 302 and a bottom cover 304 which connect to and cover frame 306.

Frame 306 is formed of any suitable size, shape and design. In the arrangement shown, frame has a generally flat mounting plate 308 with a support arm 310 extending outwardly therefrom. Mounting plate 308 is generally flat so as to facilitate mounting to walls, ceilings or other structures. Support arm 310 extends outwardly from mounting plate 308 a distance so as to provide proper clearance for rotatable drive element 12 from the wall, ceiling or structure. In the arrangement shown, support arm 310 is formed of a pair of support members that connect to one another so as to provide adequate strength and rigidity. A socket 312 is positioned at the end of support arm 310. Socket 312, when viewed from the side forms a generally semi-circular shape that is sized and shaped to receive the circular shape of the motor assembly 18 within close and tight tolerances, including frictional engagement, so that motor assembly 18 is held within socket 312. In this arrangement, motor housing 18, as well as rotatable drive element 12 can be slid within and held by socket 312.

A motor controller assembly 68 and battery tube assembly 136 is connected to and held by bracket frame 306. Motor controller assembly 68 and battery tube assembly 136 are formed of any suitable size, shape and design. In the arrangement shown, motor controller assembly 68 and battery tube assembly 136 are formed together as a single unit that is removable and replaceable upon bracket frame 306.

Top cover 302 and bottom cover 304 are formed of any suitable size, shape and design. In the arrangement shown, top cover 302 and bottom cover 304 connect to bracket frame 306 and enclose motor controller assembly 68 and battery tube assembly 136 when connected to bracket frame 306. Top cover 302 and bottom cover 304 connect to bracket frame 306 by any suitable means, such as a snap fit design, a frictional engagement, fasteners (such as screws or bolts, or the like). However, to facilitate easy installation and replacement, top cover 302 and bottom cover 304 are magnetically connected or held in place to bracket frame 306. In the arrangement shown, a magnet 314 is connected to the interior bottom surface of the top cover 302, and a corresponding magnet 314 is positioned on the top surface of the support arm 310 such that when top cover 302 is installed over bracket frame 306, the magnets 314 connected to the top cover 302 and the support arm 310 magnetically engage one another thereby holding the top cover 302 in place while allowing easy removal without tools. Similarly, a magnet 314 is positioned on the interior sides of bottom cover 304 and corresponding magnets 314 are connected to the bottom portion of the support arm 310 such that when top cover 302 is installed over bracket frame 306, the magnets 314 connected to the bottom cover 304 and the support arm 310 magnetically engage one another thereby holding the bottom cover 304 in place while allowing easy removal without tools.

Motor controller assembly 68 and battery tube assembly 136 removably and replaceably connect to bracket frame 306 by any means known in the art. In the arrangement shown, motor controller assembly 68 and battery tube assembly 136 have a pair of rails 316 that slidably and matingly engage a pair of rails 316 that extend outwardly from the mounting plate 308 of bracket frame 306. The motor controller assembly 68 and battery tube assembly 136 have a generally elongated shape, with the battery tube assembly 136 including a plurality of batteries 140 stacked on top of one another in end-to-end engagement with one another, and as such, the battery tube assembly 136 is generally cylindrical in shape with an open face to allow for easy installation and replacement of the batteries 140 therein. The support arm 310 has an opening 318 therein that is generally circular in shape that allows a portion of the battery tube assembly 136 to extend upwardly therethrough. The battery tube assembly 316 includes a snap-fit feature 320 that locks the motor controller assembly 68 and battery tube assembly 136 onto the bracket frame 306. In the arrangement shown, snap-fit feature 320, when viewed from the side, has a chamfered top edge to facilitate insertion into opening 318 and a flat bottom surface or step that engages and holds onto the top surface of support arm 310, just above where rails 316 of mounting plate 308 terminate. In this way, motor controller assembly 68 and battery tube assembly 136 connects to and is held onto bracket 16. Once motor controller assembly 68 and battery tube assembly 136 is connected to and held by bracket 16, top cover 302 and bottom cover 304 can be placed over and conceal motor controller assembly 68 and battery tube assembly 136.

Positioned within the motor controller assembly 68 is PC board 116. In the arrangement shown, motor controller assembly serves as a cover or shell for PC board 116 so as to provide protection to these sensitive electrical. That is, PC board 116 includes the microprocessor 118, memory 120, receiver or transceiver, antenna 124, and the like. In the arrangement shown, antenna 116 is formed of a coil antenna, or an piece of wire wrapped around a tube or wrapped inside a tube in a helical shape or a coil. In this arrangement, antenna 124 is positioned at the bottom of the PC board 116 to position it below the batteries 140 and away from the magnetic fields that resonate around the batteries which causes interference. An electrical socket 322 connected to the bottom of PC board 116 so as to facilitate electrical connection of the motor controller assembly 68 and battery tube assembly 136 to the motor housing 18 to provide power and control to motor 76. Any electrical socket 322 is hereby contemplated for use, however in the arrangement shown, a 12-wire socket is shown which provides adequate avenues for transfer of electric power as well as control signals between motor controller assembly 68 and motor housing 18.

Motor housing 18 includes a similar if not identical electrical socket 322. This socket 322 is positioned in the back side of motor housing 18. To facilitate access to electrical socket 322 in motor housing 18 a notch 324 is positioned in socket 312. Socket 312 also has an opening 326 therein that receives mounting post 328 connected to motor housing 18. In the arrangement shown, mounting post 328 is a threaded shaft that extends through opening 326 and receives a thumb screw 330 on the opposite side of socket 312 thereby binding and holding motor housing 18 within socket 312. This arrangement facilitates easy installation and removal of motor housing 18 to bracket 16. A conventional wire and plug arrangement is used to connect the electrical socket 322 in the motor housing 18 to the electrical socket 322 connected to the motor controller assembly 68.

Motor housing 18 includes motor 78 which is connected to transmission 78. Drive shaft 80 then connects to a motor adapter 332 which connects to motor coupler 104. A pair of bearings 102 and a spacer 334, positioned between the bearings 102, are positioned between the transmission 78 and the motor coupler 104. In the arrangement shown, motor adapter 332 is a plastic, composite part or somewhat compressible and forgiving part, whereas the motor coupler 104 is a metallic or hard or rigid part. The purpose of having the motor adapter 332 being plastic, composite or compressible while motor coupler 104 is hard or metallic is that the motor coupler 332 provides some give and allows for a frictional engagement with the motor coupler whereas use of metal for the motor coupler 104 provides superior durability, life and strength. Positioned at the opposite end of motor 76 is a second PC board 116 which contains the remaining electronic components needed to operate the system. This second PC board 116 includes the Hall Effect sensors, as are described herein, as well as an accelerometer or other sensor for sensing vibration to activate the motor, as is described herein.

Opposing rotatable drive elements 12 are either independently rotatable, or rotate in unison with one another. The arrangement providing for independent rotation is shown with respect to FIGS. 34 and 35 whereas dependent rotation, or rotation in unison is presented with respect to FIG. 36.

For independent rotation, a center support shaft 336 is provided with a circular collar 338 positioned at its middle with a stop 340 positioned on either side of the circular collar 338. A bushing 342 having a bearing 344 therein is positioned over each end of the center support shaft 336. The exterior surface of bushings 342 have a gear tooth arrangement that is shaped to receive the interior surface 166 of the open end 168 of rotatable drive elements 12. Stops 340 have angled or chamfered edges that facilitate frictional engagement insertion within bushings 342, however when busing 342 is inserted fully over center support shaft 336, stop 340 is received within a recess 346 of bushing 342 so that stop 340 does not engage bushing 342. This arrangement requires frictional insertion and removal of busing 340 over stops 342, while allowing free rotation while fully assembled. Also, this arrangement allows the rotatable drive elements 12 on either side of the center support shaft 336 to rotate independent of one another on bearing 344. This arrangement provides for simple and easy direct mounting of center bracket 16 directly to the circular collar 338 of center support shaft 336 as the center support shaft 336 does not, itself, rotate.

Figure 36:
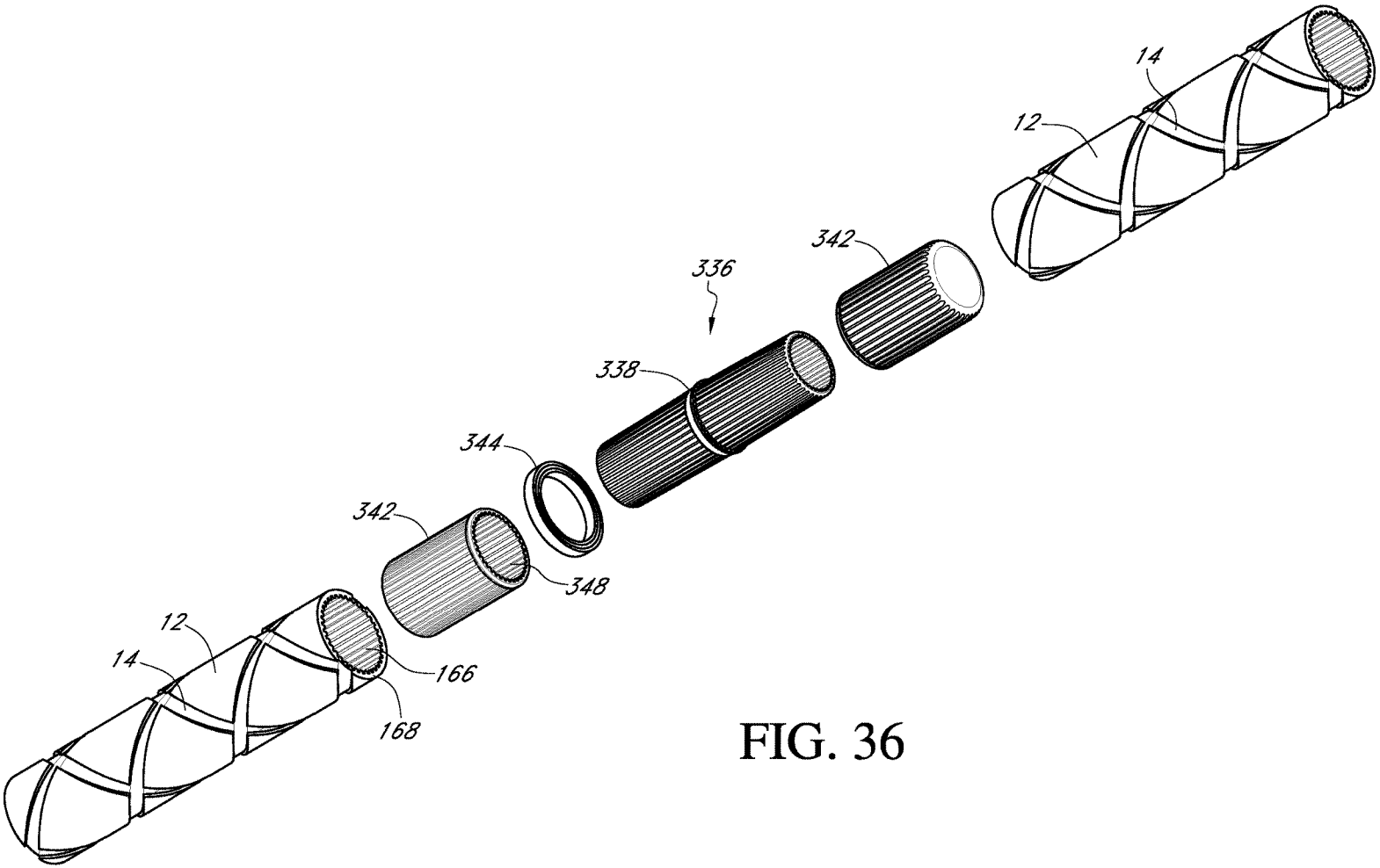
FIG. 36 is an exploded perspective view of a center support shaft with a circular collar and a bearing positioned at its middle with a stop positioned on either side of the circular collar a pair of and bushings that allow for dependent or simultaneous rotation of the rotatable drive elements.

In a similar but slightly different arrangement, for dependent rotation, a center coupler 336 is presented in FIG. 36. In this arrangement, center support shaft 336 has a circular collar 338 at its center that is smooth with gear teeth in the exterior surface outside of the circular collar. Bearing 344 is positioned over the circular collar 338 whereas bushings 342 having corresponding gear teeth in their interior surface 348 are pushed over the center coupler 336 in mating engagement. In this way, the bearing 344 is held at the center of center coupler 336 over circular collar 338. Similar to the above arrangement, bushings 342 have gear teeth in their exterior surface that correspond with the gear teeth 166 in the interior surface of rotatable drive elements 12. In this arrangement, the exterior surface of bearing 344 does not rotate and therefore center bracket 16 can connect to the exterior surface of bearing 344 while allowing the two rotatable drive elements 12 to rotate in unison.

From the above discussion it will be appreciated that the motorized drapery apparatus presented improves upon the state of the art.

Specifically, the motorized drapery apparatus presented is easy to use, is efficient, is simple in design, is inexpensive, has a minimum number of parts, has an intuitive design, is easy to install, eliminates the need to position the batteries in the rotatable drive element, eliminates the need for an external battery tube assembly, eliminates the need to position the batteries in a finial or a rotatable drive element extension, is wirelessly controllable, provides a secure and novel manner and method of connecting the battery tube assembly to the brackets, indexes the guide structure on the rotatable drive element such that two rotatable drive elements can be connected together with the guide structures aligning with one another, among countless other advantages and improvements.

It will be appreciated by those skilled in the art that other various modifications could be made to the device without parting from the spirit and scope of this invention. All such modifications and changes fall within the scope of the claims and are intended to be covered thereby.

What is claimed:

1. A motorized drapery system, comprising:

a first drive element;

wherein the first drive element is an elongated tube having a cylindrical exterior surface;

wherein the first drive element includes a helical guide structure positioned in the exterior surface of the elongated tube;

the first drive element supported by a first bracket and a second bracket;

a motor operably connected to the first drive element;

the first bracket having an open interior;

wherein the open interior houses a battery holding assembly;

at least one battery positioned within the open interior of the first bracket;

the at least one battery electrically connected to the motor; and a cover;

wherein the cover is placed over the open interior of the first bracket;

wherein when the motor is activated, the motor rotates thereby rotating the first drive element thereby laterally opening or closing shade material connected to the first drive element.

2. The system of claim 1, wherein the shade material is connected to a first drive attachment element positioned around the first drive element, wherein the first drive attachment element is in communication with the helical guide structure of the first drive element such that rotation of the first drive element causes the first drive attachment element to move laterally along a length of the first drive element thereby laterally opening or closing the shade material connected to the first drive attachment element.

3. The system of claim 1, further comprising a motor housing, which houses the motor, is positioned between the first bracket and the first drive element.

4. The system of claim 3, wherein the motor housing is positioned in alignment with an axis of rotation of the first drive element.

5. The system of claim 1, further comprising a second drive element connected to the first drive element at a center coupler such that the first drive element and the second drive element rotate in unison with one another or rotate independently of one another.

6. The system of claim 1, further comprising at least one driver attachment element and a plurality of idler attachment elements positioned around the first drive element.

7. The system of claim 1, further comprising a sensor connected to the motorized drapery system, wherein the sensor detects vibration and in response the motor is activated thereby opening or closing the shade material.

8. The system of claim 1, wherein the first drive element includes a hollow interior that extends the entire length of the first drive element.

9. A motorized drapery system, comprising:

a first drive element;

wherein the first drive element is an elongated tube having a cylindrical exterior surface;

wherein the first drive element includes a helical guide structure positioned in the exterior surface of the elongated tube;

the first drive element supported by a first bracket and a second bracket;

a motor operably connected to the first drive element;

a battery holding assembly electrically connected to the motor;

wherein the battery holding assembly is held within the first bracket;

at least one battery positioned within the battery holding assembly;

a cover;

wherein the cover is placed over the battery holding assembly of the first bracket;

wherein when the motor is activated, the motor rotates thereby rotating the first drive element thereby laterally opening or closing shade material connected to the first drive element.

10. The system of claim 9, wherein the shade material is connected to a first drive attachment element positioned around the first drive element, wherein the first drive attachment element is in communication with the helical guide structure of the first drive element such that rotation of the first drive element causes the first drive attachment element to move laterally along a length of the first drive element thereby laterally opening or closing the shade material connected to the first drive attachment element.

11. The system of claim 9, further comprising a motor housing positioned between the first bracket and the first drive element.

12. The system of claim 11, wherein the motor housing is positioned in alignment with an axis of rotation of the first drive element.

13. The system of claim 9, further comprising a second drive element connected to the first drive element at a center coupler such that the first drive element and the second drive element rotate in unison with one another or rotate independently of one another.

14. The system of claim 9, further comprising at least one driver attachment element and a plurality of idler attachment elements positioned around the first drive element.

15. The system of claim 9, further comprising a sensor connected to the motorized drapery system, wherein the sensor detects vibration and in response the motor is activated thereby opening or closing the shade material.

16. The system of claim 9, wherein the first drive element includes a hollow interior that extends the entire length of the first drive element.

17. A motorized drapery system, comprising:

a first drive element extending a length between opposing ends;

wherein the first drive element is an elongated tube having a cylindrical exterior surface;

wherein the first drive element includes a helical guide structure positioned in the exterior surface of the elongated tube;

the first drive element having a hollow interior with a plurality of teeth and a key feature;

a second drive element extending a length between opposing ends;

wherein the second drive element is an elongated tube having a cylindrical exterior surface;

wherein the second drive element includes a helical guide structure positioned in the exterior surface of the elongated tube;

the second drive element having a hollow interior with a plurality of teeth and a key feature;

a center coupler having a plurality of teeth and a key feature that corresponds to the plurality of teeth and the key feature of the first drive element and second drive element;

wherein when the center coupler is inserted into an open end of the first drive element such that the plurality of teeth and the key feature of the center coupler mesh with the plurality of teeth and key feature of the open end of the first drive element and is inserted into an open end of the second drive element such that the plurality of teeth and the key feature of the center coupler mesh with the plurality of teeth and key feature of the open end of the second drive element the helical guide structure in the exterior surface of the first drive element and the helical guide structure in the exterior surface of the second drive element are aligned with one another.

18. The system of claim 17, further comprising wherein shade material is connected to a first drive attachment element positioned around the first drive element, wherein the first drive attachment element is in communication with the helical guide structure of the first drive element such that rotation of the first drive element causes the first drive attachment element to move laterally along a length of the first drive element thereby laterally opening or closing the shade material connected to the first drive attachment element.

19. The system of claim 17, wherein the center coupler requires simultaneous rotation of the first drive element and the second drive element.

20. The system of claim 17, further comprising a motor, the motor operatively connected to the first drive element and configured to rotate the first drive element.

21. The system of claim 17, further comprising at least one driver attachment element and a plurality of idler attachment elements positioned around the first drive element.

22. The system of claim 17, further comprising a battery holding assembly positioned in the first bracket, wherein the battery holding assembly is configured to receive at least one battery therein.

23. The system of claim 17, wherein the hollow interior of the first drive element extends the length of the first drive element and the hollow interior of the second drive element extends the length of the second drive element.

* * * * *